US008564262B2

(12) United States Patent
Bose et al.

(10) Patent No.: US 8,564,262 B2
(45) Date of Patent: Oct. 22, 2013

(54) VOLTAGE REGULATOR MODULE WITH POWER GATING AND BYPASS

(75) Inventors: Pradip Bose, Yorktown Heights, NY (US); Alper Buyuktosunoglu, White Plains, NY (US); Hans M. Jacobson, White Plains, NY (US); Seongwon Kim, Old Tappan, NJ (US)

(73) Assignee: International Business Machines Corporation, Armonk, NY (US)

( * ) Notice: Subject to any disclaimer, the term of this patent is extended or adjusted under 35 U.S.C. 154(b) by 337 days.

(21) Appl. No.: 12/944,392

(22) Filed: Nov. 11, 2010

(65) Prior Publication Data

US 2012/0119717 A1 May 17, 2012

(51) Int. Cl.
*G05G 1/56* (2008.04)

(52) U.S. Cl.
USPC ..... 323/269; 323/268

(58) Field of Classification Search
USPC ..... 323/225, 226, 268, 269, 271–274; 327/551–559; 363/39; 307/105
See application file for complete search history.

(56) References Cited

U.S. PATENT DOCUMENTS

| | | | | |
|---|---|---|---|---|
| 6,060,914 | A * | 5/2000 | Nunokawa | 327/91 |
| 6,376,909 | B1 | 4/2002 | Forbes et al. | |
| 7,170,772 | B1 * | 1/2007 | Buyuktosunoglu et al. | 365/129 |
| 7,518,355 | B2 | 4/2009 | Grassi et al. | |
| 7,598,630 | B2 | 10/2009 | Burton | |
| 7,671,456 | B2 | 3/2010 | Narendra et al. | |
| 2003/0081389 | A1 | 5/2003 | Nair et al. | |
| 2009/0059627 | A1 * | 3/2009 | Kim | 363/40 |
| 2009/0059628 | A1 * | 3/2009 | Kim | 363/40 |
| 2009/0096289 | A1 | 4/2009 | Briere et al. | |
| 2009/0195227 | A1 * | 8/2009 | Morino | 323/224 |
| 2009/0206952 | A1 * | 8/2009 | Dreps et al. | 333/181 |
| 2009/0219064 | A1 * | 9/2009 | Ikeda | 327/136 |
| 2009/0296360 | A1 | 12/2009 | Doblar et al. | |
| 2010/0072961 | A1 | 3/2010 | Kosonocky et al. | |

FOREIGN PATENT DOCUMENTS

TW 282915 6/2007

OTHER PUBLICATIONS

Jiang, Hailin et al., "Benefits and Costs of Power-Gating Technique", Computer Design: VLSI in Computers and Processors, 2005, ICCD 2005. Proceedings, 2005 IEEE International Conference on Digital Object Identifier: 10.1109/ICCD.2005.34, pp. 559-566.

(Continued)

*Primary Examiner* — Adolf Berhane
*Assistant Examiner* — Gustavo Rosario Benitez
(74) *Attorney, Agent, or Firm* — Francis Lammes; Stephen J. Walder, Jr.; William J. Stock

(57) ABSTRACT

Mechanisms are provided for either power gating or bypassing a voltage regulator. Responsive to receiving an asserted power gate signal to power gate the output voltage of the voltage regulator, at least one of first control circuitry power gates the output voltage of a first circuit or second control circuitry power gates the output voltage of a second circuit such that substantially no voltage to is output by the first circuit to a primary output node. Responsive to receiving an asserted bypass signal to bypass the output voltage of the voltage regulator, at least one of the first control circuitry bypasses the output voltage of the first circuit or the second control circuitry bypasses the output voltage of a second circuit such that substantially the voltage of a voltage source is output by the first circuit to the primary output node.

16 Claims, 16 Drawing Sheets

(56) References Cited

OTHER PUBLICATIONS

Kapoor, Bhanu et al., "Impact of SoC Power Management Techniques on Verification and Testing", Quality of Electronic Design, 2009, Quality Electronic Design Digital Object Identifier: 10.1109/ISQED.2009.4810377, pp. 692-695.

Mak, T.M., "Testing of Power Constraint Computing", Asian Test Symposium, 2007, ATS, '07, 16th Digital Object Identifier: 10.1109/ATS.2007.107, p. 6.

Wen, Huajun et al., "Processor Voltage Regulation", USPTO Application U.S. Appl. No. 12/650,516, filed Dec. 30, 2009, 32 pages.

Zhang, Yanli et al., "A Novel Isolation Power Supply for Gating Multiple Devices in FACTS Equipment", Power Electronics and Drive Systems, 2007, PEDS '07, 7th International Conference on Digital Object Identifier: 10.1109/PEDS.2007.4487688, pp. 117-119.

* cited by examiner

VOLTAGE REGULATOR MODULE WITH POWER GATING AND BYPASS

BACKGROUND

The present application relates generally to an improved data processing apparatus and method and more specifically to mechanisms for power gating and bypassing a voltage regulator module.

A voltage regulator module or VRM, sometimes called processor power module (PPM), is an electronic device that provides a microprocessor the appropriate supply voltage. Voltage regulators can be used to control or adjust an incoming source of electrical potential to meet specific requirements of the electronic device. A voltage regulator can increase or decrease the voltage provided by the source, and can be used to provide a substantially constant voltage to the device despite variations in the current dissipated by the device or variations in the value of the incoming source voltage. A portion of power that is supplied to an input of a voltage regulator is dissipated by the regulator and is thus not provided at the voltage regulator's output. The amount of power provided by a voltage regulator, expressed as a percentage fraction of the power received, can be referred to as the voltage conversion efficiency of the voltage regulator.

SUMMARY

In one illustrative embodiment, a circuit structure for power gating a voltage regulator is provided. In the illustrative embodiment, first control circuitry, in a first circuit of the voltage regulator, is configured to remove frequency components of an output voltage in a first frequency range. In the illustrative embodiment, the first control circuitry receives a first signal to power gate the output voltage of the first circuit and wherein by the first control circuitry power gating the output voltage of the first circuit causes substantially no voltage to be output by the first circuit to a primary output node. In the illustrative embodiment, second control circuitry, in a second circuit of the voltage regulator, has first and second inverters electrically coupled to the primary output node of the first circuit, the second circuit is configured to remove frequency components of the output voltage in a second frequency range. In the illustrative embodiment, the second frequency range being greater than the first frequency range. In the illustrative embodiment, the second control circuitry receives the first signal to power gate the output voltage of the second circuit. In the illustrative embodiment, the second control circuitry power gating the output voltage of the second circuit causes substantially no voltage to be output by the second circuit to the primary output node.

In another illustrative embodiment, a circuit structure for bypassing a voltage regulator is provided. In the illustrative embodiment, first control circuitry, in a first circuit of the voltage regulator, is configured to remove frequency components of an output voltage in a first frequency range. In the illustrative embodiment, the first control circuitry receives a first signal to bypass the output voltage of the first circuit and wherein by the first control circuitry bypassing the output voltage of the first circuit causes substantially the voltage of a voltage source to be output by the first circuit to a primary output node. In the illustrative embodiment, second control circuitry, in a second circuit of the voltage regulator, has first and second inverters electrically coupled to the primary output node of the first circuit, the second is circuit configured to remove frequency components of the output voltage in a second frequency range. In the illustrative embodiment, the second frequency range being greater than the first frequency range. In the illustrative embodiment, the second control circuitry receives the first signal to bypass the output voltage of the second circuit. In the illustrative embodiment, the second control circuitry bypassing the output voltage of the second circuit causes substantially the voltage of the voltage source to be output by the second circuit to the primary output node.

In yet another illustrative embodiment, a circuit structure for either power gating or bypassing a voltage regulator is provided. In the illustrative embodiment, first control circuitry, in a first circuit of the voltage regulator, is configured to remove frequency components of an output voltage in a first frequency range. In the illustrative embodiment, the first control circuitry receives either a power gate signal or a bypass signal to either power gate or bypass the output voltage of the first circuit. In the illustrative embodiment, responsive to the power gate signal being asserted to power gate to output voltage, the first control circuitry power gates the output voltage of the first circuit such that substantially no voltage to is output by the first circuit to a primary output node. In the illustrative embodiment, responsive to the bypass signal being asserted to bypass to output voltage, the first control circuitry bypasses the output voltage of the first circuit such that substantially the voltage of a voltage source is output by the first circuit to the primary output node. In the illustrative embodiment, second control circuitry, in a second circuit of the voltage regulator, has first and second inverters electrically coupled to the primary output node of the first circuit, the second circuit is configured to remove frequency components of the output voltage in a second frequency range. In the illustrative embodiment, the second control circuitry receives either the power gate signal or the bypass signal to either power gate or bypass the output voltage of the first circuit. In the illustrative embodiment, responsive to the power gate signal being asserted to power gate to output voltage, the second control circuitry power gates the output voltage of the first circuit such that substantially no voltage to is output by the first circuit to the primary output node. In the illustrative embodiment, responsive to the bypass signal being asserted to bypass to output voltage, the second control circuitry bypasses the output voltage of the first circuit such that substantially the voltage of a voltage source is output by the first circuit to the primary output node.

These and other features and advantages of the present invention will be described in, or will become apparent to those of ordinary skill in the art in view of, the following detailed description of the example embodiments of the present invention.

BRIEF DESCRIPTION OF THE SEVERAL VIEWS OF THE DRAWINGS

The invention, as well as a preferred mode of use and further objectives and advantages thereof, will best be understood by reference to the following detailed description of illustrative embodiments when read in conjunction with the accompanying drawings, wherein.

DETAILED DESCRIPTION

The illustrative embodiments provide a mechanism where a voltage regulator module (VRM) circuit may be extended with the functionality to override the senseamp output to provide either full-on or full-off current supply capability. The invention adds a control circuit on the path between the senseamp and the current supply device. The control circuit controls whether the senseamp output is to be used to regulate the current supply device or whether the senseamp output should be ignored. If the senseamp output is ignored, then the control circuit can either turn the current supply device fully on or fully off, causing it to act as a power gating header device.

Figure 1:
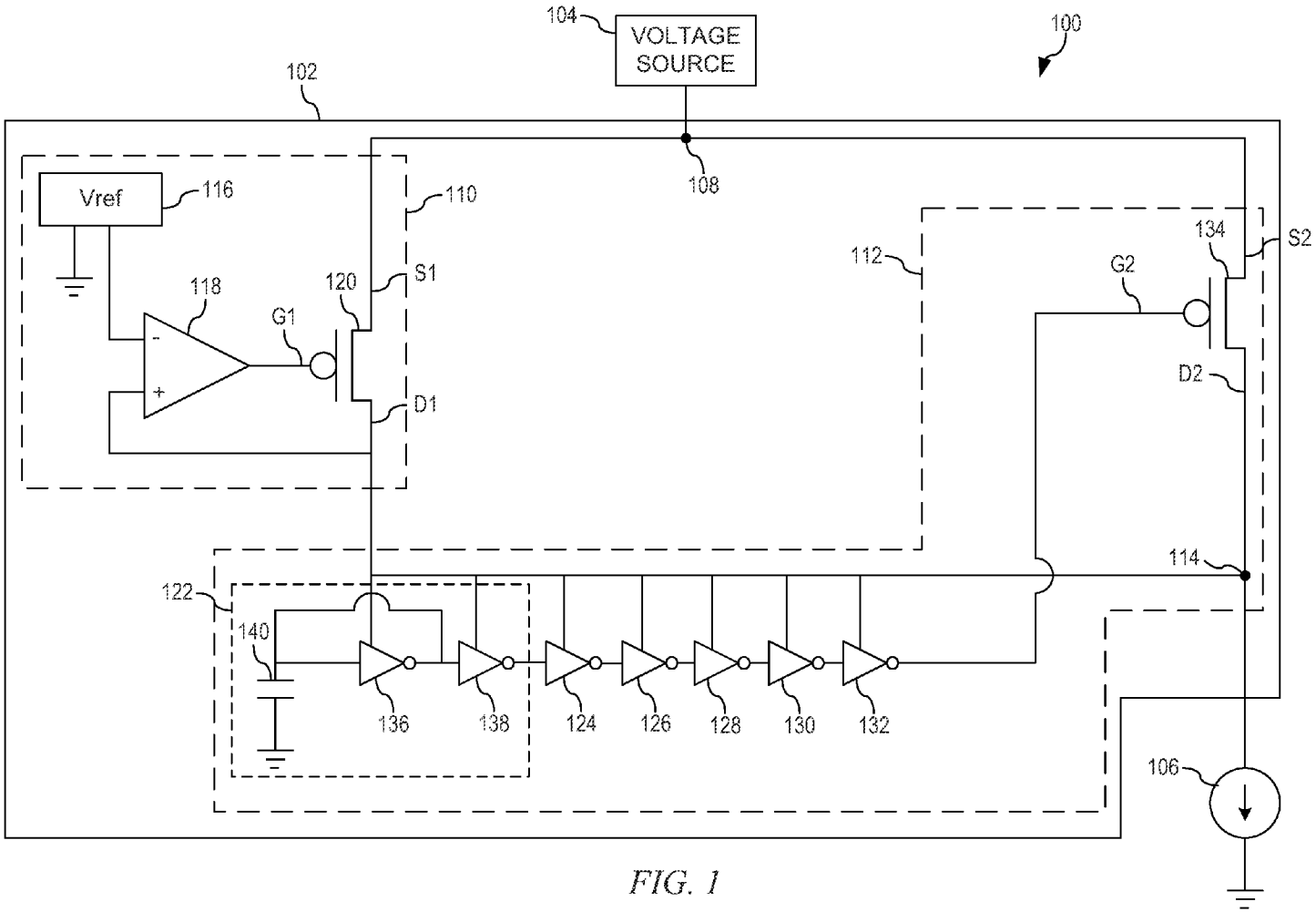
FIG. 1 (Prior Art)
FIG. 1 is an electrical schematic of an electrical system having a voltage regulator in accordance with an exemplary embodiment.

Referring to FIG. 1, an electrical system 100 having voltage regulator 102 in accordance with an exemplary embodiment is illustrated. Electrical system 100 further includes voltage source 104 and load 106. During operation, load 106 may cause undesirable voltage deviations and/or frequency components at primary output node 114 of voltage regulator 102. An advantage of voltage regulator 102 is that the regulator is able to output a voltage that has minimal voltage deviation for voltage-sensitive load devices. Voltage source 104 is provided to output a voltage at a desired voltage level. Voltage source 104 is electrically coupled to voltage regulator 102 at point 108. Voltage regulator 102 is provided to receive the voltage from voltage source 104 and to output a voltage with minimal voltage deviation from a desired voltage level. Voltage regulator 102 includes circuit 110, which may be referred to as a low frequency main loop, and circuit 112, which may be referred to as a high frequency micro loop.

Circuit 110 is provided to remove frequency components of the voltage in a first frequency range to obtain an output voltage at primary output node 114 with reduced voltage deviation. In one exemplary embodiment, circuit 110 is configured to remove frequency components of the voltage in the frequency range of 0 to 10 Megahertz. Of course, in alternative embodiments of circuit 110, circuit 110 may remove frequency components in other frequency ranges. Circuit 110 includes voltage reference device 116, operational amplifier 118, and P-FET transistor 120. Operational amplifier 118 has an inverting input terminal "−", a non-inverting input terminal "+", and an output terminal. P-FET transistor 120 has a gate terminal (G1), a source terminal (S1), and a drain terminal (D1). Voltage reference device 116 is electrically coupled to the inverting input terminal "−" of operational amplifier 118. Voltage reference device 116 is configured to output a desired reference voltage level. The output terminal of operational amplifier 118 is electrically coupled to the gate terminal (G1) of P-FET transistor 120. The non-inverting terminal "+" of operational amplifier 118 is electrically coupled to the drain terminal (D1) of P-FET transistor 120 and further coupled to primary output node 114.

During operation of circuit 110, when the output voltage of voltage source 104 decreases, the voltage received by the non-inverting terminal "+" of operational amplifier 118 has a low logic voltage relative to a high logic voltage on the inverting terminal "−", which induces operational amplifier 118 to output a low logic voltage. In response to the low logic voltage on the gate terminal (G1) of P-FET transistor 120, P-FET transistor 120 increases current flowing from the source terminal (S1) to the drain terminal (D1) which causes the output voltage on primary output node 114 to increase. Alternately, when the output voltage of voltage source 104 increases, the voltage received by the non-inverting terminal "+" of operational amplifier 118 has a high logic voltage relative to a low logic voltage on the inverting terminal "−", which induces operational amplifier 118 to output a high logic voltage. In response to the high logic voltage on the gate terminal (G1) of P-FET transistor 120, P-FET transistor 120 decreases current flowing from the source terminal (S1) to the drain terminal (D1) which causes the output voltage on primary output node 114 to decrease.

Circuit 112 is provided to remove frequency components of the voltage in a second frequency range to obtain an output voltage at primary output node 114 with reduced voltage deviation. In one exemplary embodiment, circuit 112 is configured to remove frequency components of the voltage in the frequency range of 10 Megahertz to 6 Gigahertz. Of course, in alternative embodiments of circuit 112, circuit 112 may remove frequency components in other frequency ranges. Circuit 112 includes comparator circuit 122, inverters 124, 126, 128, 130, 132, and P-FET transistor 134.

Figure 2:
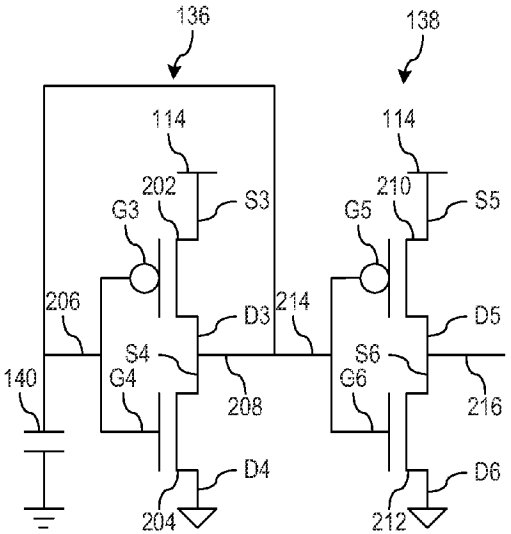
FIG. 2 (Prior Art)
FIG. 2 is an electrical schematic of a comparator circuit utilized in the voltage regulator of FIG. 1 in accordance with an illustrative embodiment.

Referring to FIGS. 1 and 2, comparator circuit 122 is provided to detect a voltage deviation on primary output node 114. The comparator circuit 122 includes inverters 136 and 138 and capacitor 140.

Inverter 136 includes P-FET transistor 202, N-FET transistor 204, input terminal 206, and output terminal 208. P-FET transistor 202 includes a gate terminal (G3), a source terminal (S3), and a drain terminal (D3). N-FET transistor 204 includes a gate terminal (G4), a source terminal (S4), and a drain terminal (D4). P-FET transistor 202 is electrically coupled to N-FET transistor 204. In particular, the gate terminals (G3) and (G4) are electrically coupled together at input terminal 206. The source terminal (S3) is electrically coupled to primary output node 114. The drain terminal (D3) is electrically coupled to the source terminal (S4) at output terminal 208. Output terminal 208 is electrically coupled to input terminal 206. The drain terminal (D4) is electrically coupled to electrical ground. Capacitor 140 is electrically coupled between the input terminal 206 and electrical ground. During operation, a voltage on output terminal 208 is less than the output voltage at the primary output node 114. In particular, a voltage on the output terminal 208 is approximately one-half of the voltage at the primary output node 114.

Inverter 138 includes P-FET transistor 210, N-FET transistor 212, input terminal 214, and output terminal 216. P-FET transistor 210 includes a gate terminal (G5), a source terminal (S5), and a drain terminal (D5). N-FET transistor 212 includes a gate terminal (G6), a source terminal (S6), and a drain terminal (D6). P-FET transistor 210 is electrically coupled to N-FET transistor 212. In particular, the gate terminals (G5) and (G6) are electrically coupled together at input terminal 214. Input terminal 214 is electrically coupled to the output terminal 208. The source terminal (S5) is electrically coupled to primary output node 114. The drain terminal (D5) is electrically coupled to the source terminal (S6) at output terminal 216. Output terminal 216 is electrically coupled to inverter 124. The drain terminal (D6) is electrically coupled to electrical ground.

During operation of comparator circuit 122, when an output voltage at primary output node 114 is increased, the voltage on output terminal 208 of inverter 136 is less than the output voltage on primary output node 114 which induces inverter 138 to output a high logic voltage on output terminal 216. The high logic voltage is utilized to subsequently induce P-FET transistor 134 to reduce the output voltage on primary output node 114 in response to the high logic voltage. Alternately, when the output voltage at primary output node 114 is decreased, the voltage on output terminal 208 of inverter 136 is greater than the output voltage on primary output node 114 which induces inverter 138 to output a low logic voltage on output terminal 216. The low logic voltage is subsequently utilized to induce the P-FET transistor 134 to increase the output voltage on primary output node 114 in response to the low logic voltage.

Figure 3:
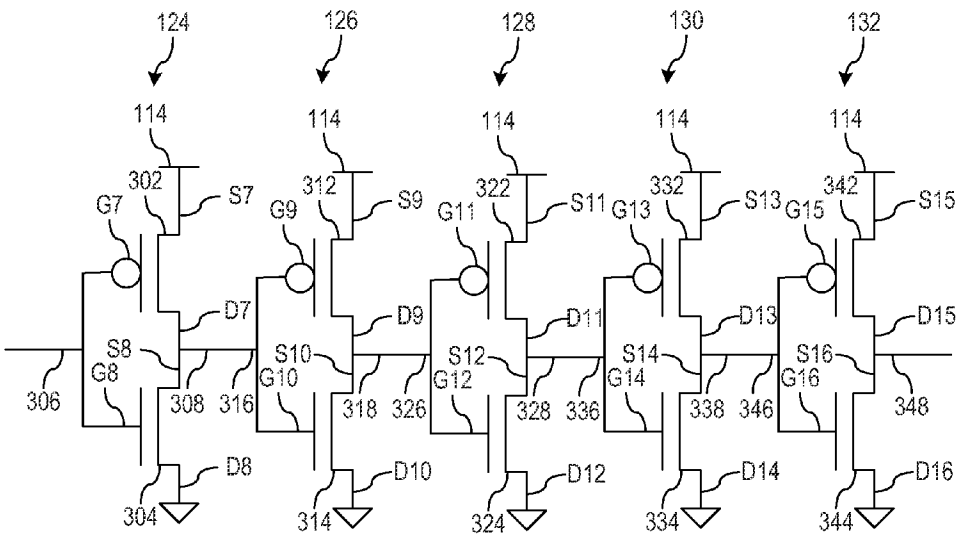
FIG. 3 (Prior Art)
FIG. 3 is an electrical schematic of a plurality of inverters utilized in the voltage regulator of FIG. 1 in accordance with an illustrative embodiment.

Referring to FIGS. 1 and 3, the chain of inverters 124, 126, 128, 130, 132 are provided to amplify the output voltage from comparator circuit 122 which is received by the gate terminal (G2) of P-FET transistor 134.

Inverter 124 includes P-FET transistor 302, N-FET transistor 304, input terminal 306, and output terminal 308. P-FET transistor 302 includes a gate terminal (G7), a source terminal (S7), and a drain terminal (D7). N-FET transistor 304 includes a gate terminal (G8), a source terminal (S8), and a drain terminal (D8). P-FET transistor 302 is electrically coupled to N-FET transistor 304. In particular, the gate terminals (G7) and (G8) are electrically coupled together at input terminal 306. The source terminal (S7) is electrically coupled to primary output node 114. The drain terminal (D7) is electrically coupled to the source terminal (S8) at output terminal 308. Output terminal 308 is electrically coupled to input terminal 316. The drain terminal (D8) is electrically coupled to electrical ground. During operation, inverter 124 receives an output voltage at input terminal 306 from comparator circuit 122 and outputs an inverted amplified output voltage at output terminal 308.

Inverter 126 includes P-FET transistor 312, N-FET transistor 314, input terminal 316, and output terminal 318. P-FET transistor 312 includes a gate terminal (G9), a source terminal (S9), and a drain terminal (D9). N-FET transistor 314 includes a gate terminal (G10), a source terminal (S10), and a drain terminal (D10). P-FET transistor 312 is electrically coupled to N-FET transistor 314. In particular, the gate terminals (G9) and (G10) are electrically coupled together at input terminal 316. The source terminal (S9) is electrically coupled to primary output node 114. The drain terminal (D9) is electrically coupled to the source terminal (S10) at output terminal 318. Output terminal 318 is electrically coupled to input terminal 326. The drain terminal (D10) is electrically coupled to electrical ground. During operation, inverter 126 receives an output voltage at input terminal 316 from inverter 124 and outputs an inverted amplified output voltage at output terminal 318.

Inverter 128 includes P-FET transistor 322, N-FET transistor 324, input terminal 326, and output terminal 328. P-FET transistor 322 includes a gate terminal (G11), a source terminal (S11), and a drain terminal (D11). N-FET transistor 324 includes a gate terminal (G12), a source terminal (S12), and a drain terminal (D12). P-FET transistor 322 is electrically coupled to N-FET transistor 324. In particular, the gate terminals (G11) and (G12) are electrically coupled together at input terminal 326. The source terminal (S11) is electrically coupled to primary output node 114. The drain terminal (D11) is electrically coupled to the source terminal (S12) at output terminal 328. Output terminal 328 is electrically coupled to input terminal 336. The drain terminal (D12) is electrically coupled to electrical ground. During operation, inverter 128 receives an output voltage at input terminal 326 from inverter 126 and outputs an inverted amplified output voltage at output terminal 328.

Inverter 130 includes P-FET transistor 332, N-FET transistor 334, input terminal 336, and output terminal 338. P-FET transistor 332 includes a gate terminal (G13), a source terminal (S13), and a drain terminal (D13). N-FET transistor 334 includes a gate terminal (G14), a source terminal (S14), and a drain terminal (D14). P-FET transistor 332 is electrically coupled to N-FET transistor 334. In particular, the gate terminals (G13) and (G14) are electrically coupled together at input terminal 336. The source terminal (S13) is electrically coupled to primary output node 114. The drain terminal (D13) is electrically coupled to the source terminal (S14) at output terminal 338. Output terminal 338 is electrically coupled to input terminal 346. The drain terminal (D14) is electrically coupled to electrical ground. During operation, inverter 130 receives an output voltage at input terminal 336 from inverter 128 and outputs an inverted amplified output voltage at output terminal 338.

Inverter 132 includes P-FET transistor 342, N-FET transistor 344, input terminal 346, and output terminal 348. P-FET transistor 342 includes a gate terminal (G15), a source terminal (S15), and a drain terminal (D15). N-FET transistor 344 includes a gate terminal (G16), a source terminal (S16), and a drain terminal (D16). P-FET transistor 342 is electrically coupled to N-FET transistor 344. In particular, the gate terminals (G15) and (G16) are electrically coupled together at input terminal 346. The source terminal (S15) is electrically coupled to primary output node 114. The drain terminal (D15) is electrically coupled to the source terminal (S16) at output terminal 348. Output terminal 348 is electrically coupled to a gate terminal (G2) of P-FET transistor 134. The drain terminal (D16) is electrically coupled to electrical ground. During operation, inverter 132 receives an output voltage at input terminal 346 from inverter 130 and outputs an inverted amplified output voltage at output terminal 348.

It should be noted that in an alternative embodiment, voltage regulator 102 could be constructed by removing inverters 124, 126, 128, 130, 132 where inverter 138 would be directly electrically coupled to the P-FET transistor 134. Further, in other alternative embodiments, the number of inverters in the chain of inverters to amplify the voltage from the comparator circuit 122 can be greater than or less than the number of inverters shown in the chain of inverters of FIGS. 1 and 3.

Referring to FIG. 1, P-FET transistor 134 is provided to remove voltage deviations at primary output node 114. In particular, P-FET transistor 134 is provided to remove frequency components of the output voltage in a second frequency range. P-FET transistor 134 includes a gate terminal (G2), a source terminal (S2), and a drain terminal (D2). The gate terminal (G2) is electrically coupled to output terminal 348 in FIG. 3 of inverter 132. The source terminal (S2) is electrically coupled to voltage source 104. The drain terminal (D2) is electrically coupled to primary node 114. Load 106 is electrically coupled between primary output node 114 and electrical ground. Load 106 receives the output voltage from voltage regulator 102. During operation, when P-FET transistor 134 receives a high logic voltage from inverter 132 at the gate terminal (G2), P-FET transistor 134 decreases current flow to reduce the output voltage on primary output node 114 in response to the high logic voltage. Alternately, when P-FET transistor 134 receives a low logic voltage from inverter 132 at the gate terminal (G2), P-FET transistor 134 increases current flow to increase the output voltage on primary output node 114 in response to the low logic voltage.

While voltage regulator 102 decreases current flow to reduce the output voltage on primary output node 114 in response to the high logic voltage and increases current flow to increase the output voltage on primary output node 114 in response to the low logic voltage, voltage regulator 102 does not provide for either completely turning on the entire current flow or completely turning off the current flow.

Figure 4:
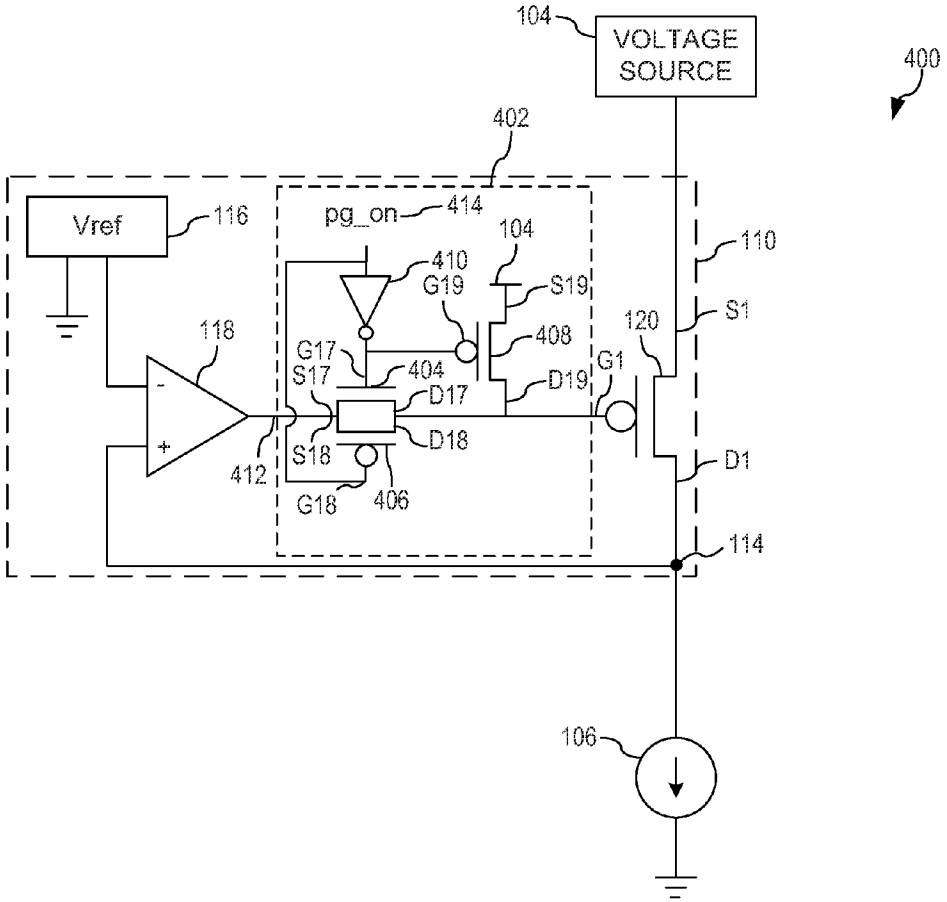
FIG. 4 is an electrical schematic of an electrical system having a voltage regulator with additional control circuitry for completely power gating or turning off the current supply of a low frequency main loop circuit 110 of FIG. 1 in accordance with an exemplary embodiment.

FIG. 4 is an electrical schematic of an electrical system having a voltage regulator with additional control circuitry for completely power gating or turning off the current supply of a low frequency main loop circuit 110 of FIG. 1 in accordance with an exemplary embodiment. Circuit 400 includes voltage reference device 116, operational amplifier 118, P-FET transistor 120, and control circuitry 402. Operational amplifier 118, P-FET transistor 120, and voltage reference device 116 operate in the manner described above in FIGS. 1-3 except when control circuitry 402 is activated. Control circuitry 402 includes N-FET transistor 404, P-FET transistors 406 and 408, and inverter 410. N-FET transistor 404 has a gate terminal (G17), a source terminal (S17), and a drain terminal (D17). P-FET transistor 406 has a gate terminal (G18), a source terminal (S18), and a drain terminal (D18). P-FET transistor 408 has a gate terminal (G19), a source terminal (S19), and a drain terminal (D19).

The source terminals (S17) and (S18) are electrically coupled together at input terminal 412. Input terminal 412 is electrically coupled to the output terminal of operational amplifier 118. The drain terminals (D17) and (D18) are electrically coupled to the drain terminal (D19) of P-FET transistor 408 and to the gate terminal (G1) of P-FET transistor 120. The gate terminal (G18) of P-FET transistor 406 is electrically coupled to a power gate (pg_on) signal 414. The gate terminal (G17) is electrically coupled to the output of inverter 410 and the input of inverter 410 is electrically coupled to the power gate signal 414. The gate terminal (G19) of P-FET transistor 408 is also electrically coupled to the output of inverter 410 and the source terminal (S19) of P-FET transistor 408 is electrically coupled to voltage source 104.

When power gate signal 414 is asserted, i.e. a "1", the gate terminal (G18) of P-FET transistor 406 receives the "1" and turns completely off. Also, gate terminal (G17) of N-FET transistor 404 receives the inverse, a "0", of the asserted power gate signal 414 through inverter 410, such that the gate terminal (G17) receives the "0" and turns completely off. Thus, the output of operational amplifier 118 is open to the gate terminal (G1) of P-FET transistor 120. Additionally, gate terminal (G19) of P-FET transistor 408 also receives the "0" from the output of inverter 410 and turns completely on. At this point, current from voltage source 104 flows through the source terminal (S19) to the drain terminal (D19) which causes gate terminal (G1) of P-FET transistor 120 to turn completely off. Thus, no current will flow through the source terminal (S1) to the drain terminal (D1) which causes the output voltage on primary output node 114 to be zero.

When power gate signal 414 is not asserted, i.e. a "0", the gate terminal (G18) of P-FET transistor 406 receives the "0" and turns completely on. Also, the gate terminal (G17) of N-FET transistor 404 receives the inverse, a "1", of the not asserted power gate signal 414 through inverter 410, such that the gate terminal (G17) receives the "1" and turns completely on. Thus, the output of operational amplifier 118 is closed to the gate terminal (G1) of P-FET transistor 120 and P-FET transistor 120 operates as described with regard to FIGS. 1-3. Additionally, gate terminal (G19) of P-FET transistor 408 also receives the "1" from the output of inverter 410 and turns completely off. At this point, no current flows from voltage source 104 through the source terminal (S19) to the drain terminal (D19). Thus, P-FET transistor 120 operates as described with regard to FIGS. 1-3.

Figure 5:
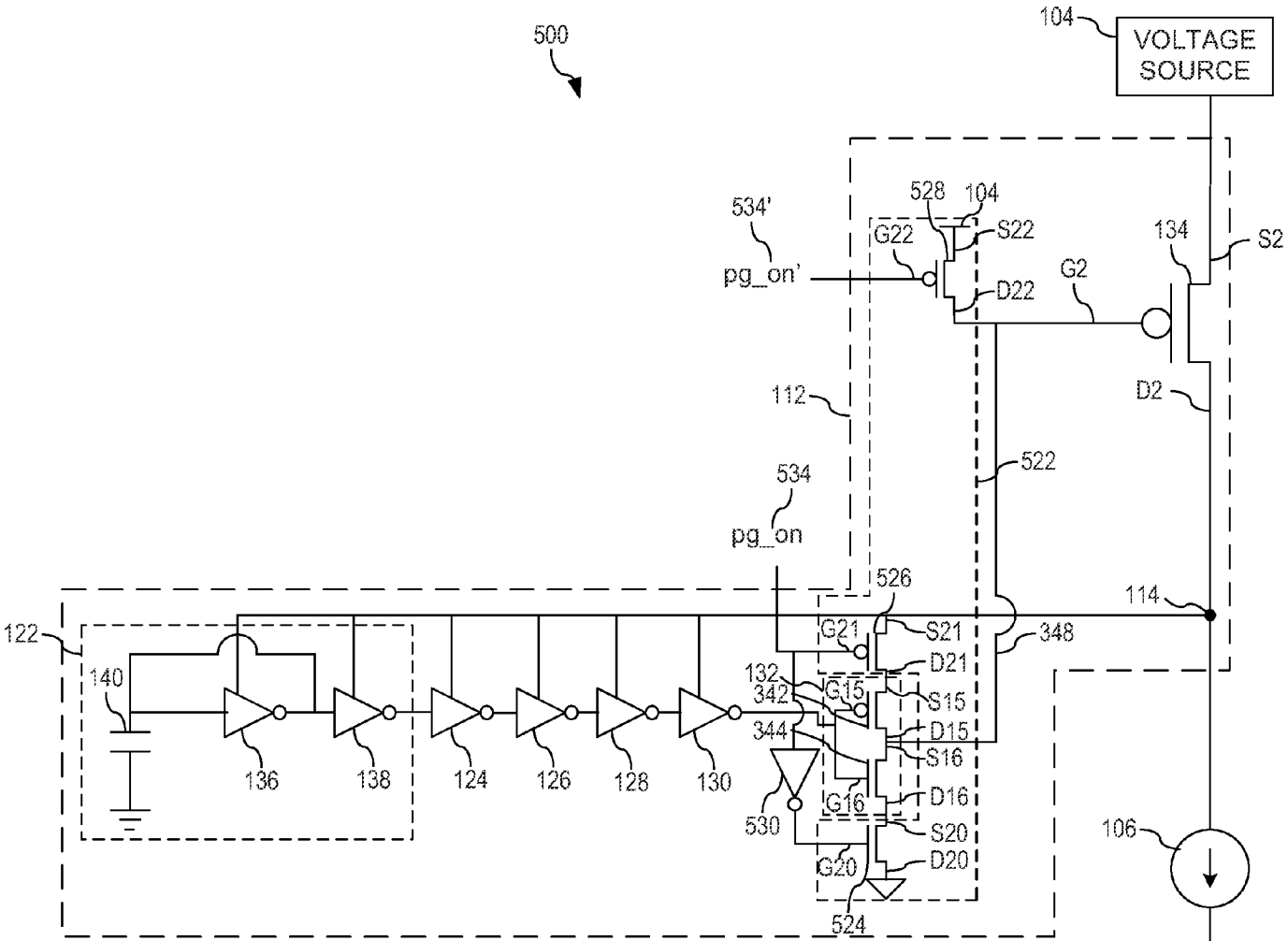
FIG. 5 is an electrical schematic of an electrical system having a voltage regulator with additional control circuitry for completely power gating or turning off the current supply of a high frequency micro loop circuit 112 of FIG. 1 in accordance with an exemplary embodiment.

FIG. 5 is an electrical schematic of an electrical system having a voltage regulator with additional control circuitry for completely power gating or turning off the current supply of a high frequency micro loop circuit 112 of FIG. 1 in accordance with an exemplary embodiment. Circuit 500 includes comparator circuit 122, inverters 124, 126, 128, 130, 132, P-FET transistor 134 and control circuitry 522. Circuit 112 includes comparator circuit 122, inverters 124, 126, 128, 130, and 132, and P-FET transistor 134, which operate in the manner described above in FIGS. 1-3 except when control circuitry 522 is activated. Control circuitry 522 includes N-FET transistor 524, P-FET transistors 526 and 528, and inverter 530. N-FET transistor 524 has a gate terminal (G20), a source terminal (S20), and a drain terminal (D20). P-FET transistor 526 has a gate terminal (G21), a source terminal (S21), and a drain terminal (D21). P-FET transistor 528 has a gate terminal (G22), a source terminal (S22), and a drain terminal (D22). Instead of the source terminal (S15) of P-FET transistor 342 being electrically coupled to primary output node 114 as is illustrated in FIG. 3, the source terminal (S15) of P-FET transistor 342 is electrically coupled to the drain terminal (D21) of P-FET transistor 526. The source terminal (S21) of P-FET transistor 526 is then electrically coupled to primary output node 114.

Also, instead of the drain terminal (D16) of N-FET transistor 344 being electrically coupled to electrical ground as is illustrated in FIG. 3, the drain terminal (D16) of N-FET transistor 344 is electrically coupled to the source terminal (S20) of N-FET transistor 524. The drain terminal (D20) of N-FET transistor 524 is then electrically coupled to electrical ground. The gate terminal (G21) of P-FET transistor 526 is electrically coupled to power gate signal 534. The gate terminal (G20) is electrically coupled to the output of inverter 530 and the input of inverter 530 is electrically coupled to power gate signal 534. The gate terminal (G22) of P-FET transistor 528 is electrically coupled to the output of inverter 530 and the source terminal (S22) of P-FET transistor 528 is electrically coupled to voltage source 104. The drain terminal (D22) is electrically coupled to the output terminal 348 of inverter 132 and to the gate terminal (G2) of P-FET transistor 134.

When power gate signal 534 is asserted, i.e. a "1", the gate terminal (G21) of P-FET transistor 526 receives the "1" and turns completely off. Also, the gate terminal (G20) of N-FET transistor 524 receives the inverse, a "0", of the asserted power gate signal 534 through inverter 530, such that the gate terminal (G20) receives the "0" and turns completely off. Thus, the output of inverter 132 is floating to the gate terminal (G2) of P-FET transistor 134. Additionally, gate terminal (G22) of P-FET transistor 528 also receives the "0" from the output of inverter 530 and turns completely on. At this point, current from voltage source 104 flows through the source terminal (S22) to the drain terminal (D22) which causes gate terminal (G2) of P-FET transistor 134 to turn completely off. Thus, no current will flow through the source terminal (S2) to the drain terminal (D2) which causes the output voltage on primary output node 114 to float.

When power gate signal 534 is not asserted, i.e. a "0", the gate terminal (G21) of P-FET transistor 526 receives the "0" and turns completely on. Also, the gate terminal (G20) of N-FET transistor 524 receives the inverse, a "1", of the not asserted power gate signal 534 through inverter 530, such that the gate terminal (G20) receives the "1" and turns completely on. Thus, the inverter 132 operates as described with regard to FIGS. 1-3. Additionally, gate terminal (G22) of P-FET transistor 528 also receives the "1" from the output of inverter 530 and turns completely off. At this point, no current flows from voltage source 104 flows through the source terminal (S22) to the drain terminal (D22). Thus, P-FET transistor 134 operates as described with regard to FIGS. 1-3.

Figure 6:
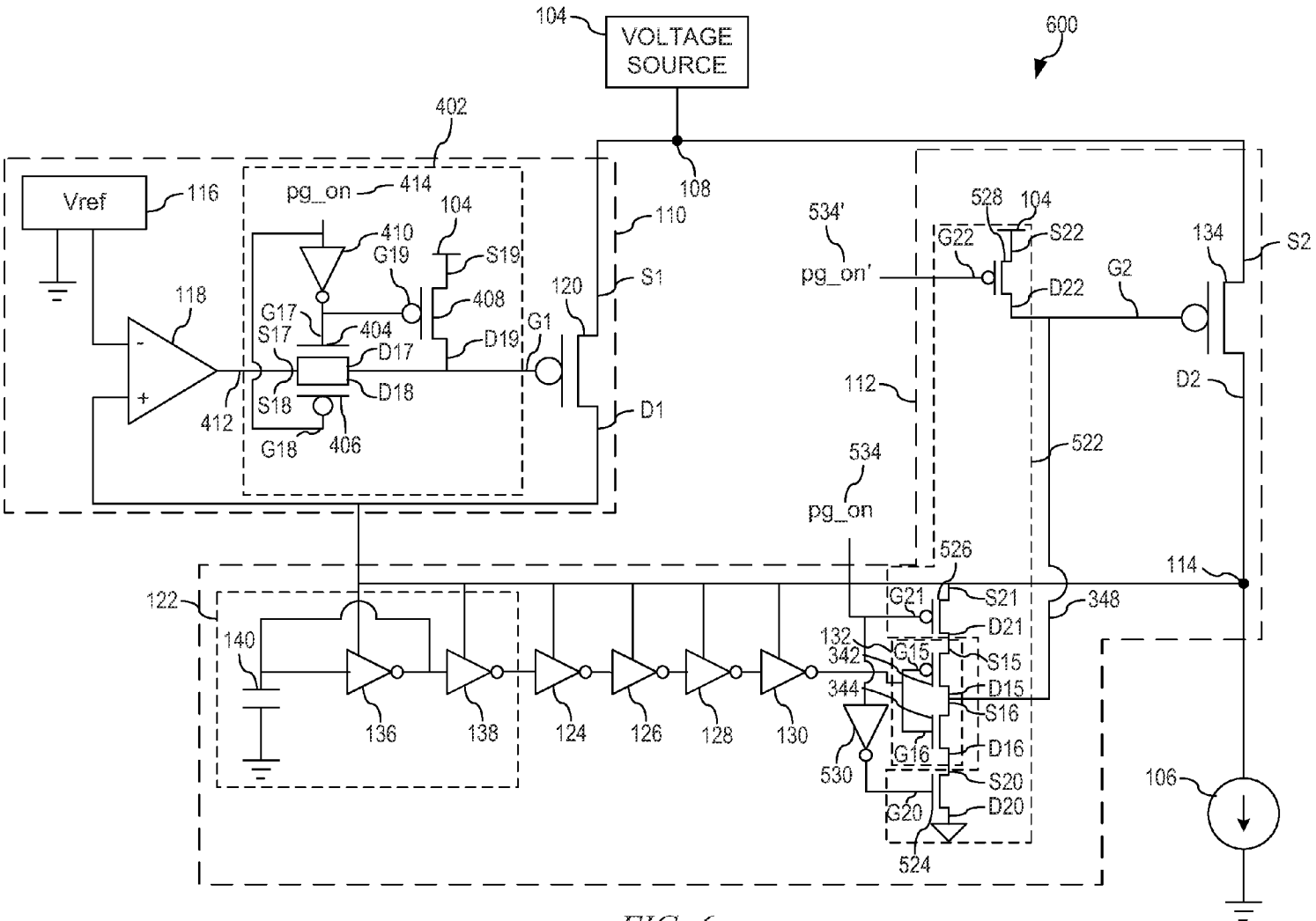
FIG. 6 is an electrical schematic of an electrical system having a voltage regulator with additional control circuitry for completely power gating or turning off the current supply of a combined low frequency main loop circuit 110 and high frequency micro loop circuit 112 of FIG. 1 in accordance with an exemplary embodiment.

FIG. 6 is an electrical schematic of an electrical system having a voltage regulator with additional control circuitry for completely power gating or turning off the current supply of a combined low frequency main loop circuit 110 and high frequency micro loop circuit 112 of FIG. 1 in accordance with an exemplary embodiment. Rather than only power gating or turning off the current supply of a low frequency main loop circuit as is shown in FIG. 4 or only power gating or turning off the current supply of a high frequency micro loop circuit as is shown in FIG. 5, FIG. 6 power gates both the low frequency main loop circuit 110 and high frequency micro loop circuit 112 of FIG. 1 at the same time. Electrical system 600 shows control circuitry 402 of FIG. 4 and control circuitry 522 of FIG. 5. When power gating is desired in electrical system 600, then power gate signal 414 and power gate signal 534, which are the same signal in this illustrative embodiment, are asserted and control circuitry 402 and control circuitry 522 operate in the manner described above in FIGS. 4 and 5. When power gating is not required, then power gate signal 414 and power gate signal 534 are not asserted and electrical system 600 operates in the manner described in FIG. 1-3.

Figure 7:
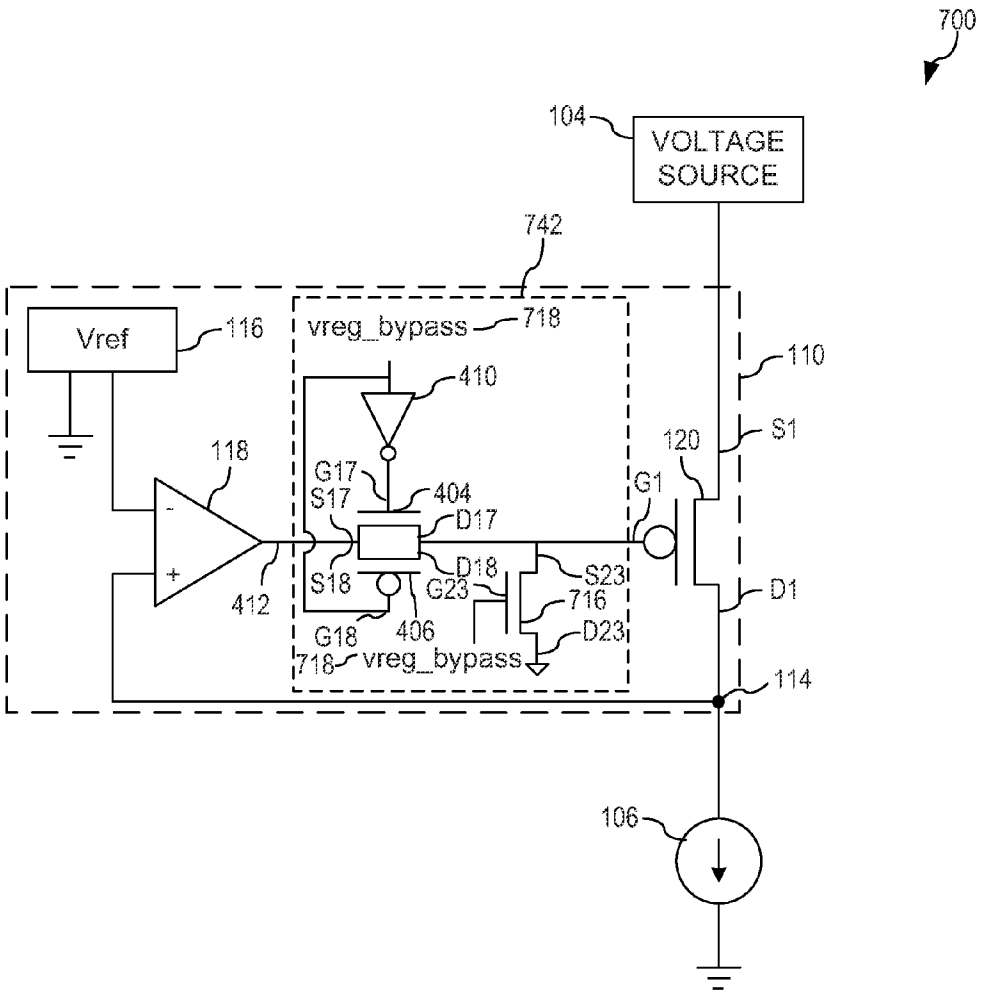
FIG. 7 is an electrical schematic of an electrical system having a voltage regulator with additional control circuitry for completely bypassing or turning on the current supply of a low frequency main loop circuit 110 of FIG. 1 in accordance with an exemplary embodiment.

FIG. 7 is an electrical schematic of an electrical system having a voltage regulator with additional control circuitry for completely bypassing or turning on the current supply of a low frequency main loop circuit 110 of FIG. 1 in accordance with an exemplary embodiment. Circuit 700 includes voltage reference device 116, operational amplifier 118, P-FET transistor 120, and control circuitry 742. Operational amplifier 118, P-FET transistor 120, and voltage reference device 116 operate in the manner described above in FIGS. 1-3 except when control circuitry 742 is activated. Control circuitry 742 is similar to control circuitry 402 of FIG. 4 other than including P-FET transistor 408, rather, control circuitry 742 includes N-FET transistor 716. Thus, control circuitry 742 includes N-FET transistors 404 and 716, P-FET transistor 406, and inverter 410. N-FET transistor 404 has a gate terminal (G17), a source terminal (S17), and a drain terminal (D17). P-FET transistor 406 has a gate terminal (G18), a source terminal (S18), and a drain terminal (D18). N-FET transistor 716 has a gate terminal (G23), a source terminal (S23), and a drain terminal (D23).

The source terminals (S17) and (S18) are electrically coupled together at input terminal 412. Input terminal 412 is electrically coupled to the output terminal of operational amplifier 118. The drain terminals (D17) and (D18) are electrically coupled to the source terminal (S23) of N-FET transistor 716 and to the gate terminal (G1) of P-FET transistor 120. The gate terminal (G18) of P-FET transistor 406 is electrically coupled to a voltage regulator bypass (vreg_bypass) signal 718. The gate terminal (G17) is electrically coupled to the output of inverter 410 and the input of inverter 410 is electrically coupled to the voltage regulator bypass signal 718. The gate terminal (G23) of N-FET transistor 716 is also electrically coupled to the output the voltage regulator bypass signal 718 and the drain terminal (D23) of N-FET transistor 716 is electrically coupled to ground.

When voltage regulator bypass signal 718 is asserted, i.e. a "1", the gate terminal (G18) of P-FET transistor 406 receives the "1" and turns completely off. Also, the gate terminal (G17) of N-FET transistor 404 receives the inverse, a "0", of the asserted voltage regulator bypass signal 718 through inverter 410, such that the gate terminal (G17) receives the "0" and turns completely off. Thus, the output of operational amplifier 118 is open to the gate terminal (G1) of P-FET transistor 120. Additionally, gate terminal (G23) of N-FET transistor 716 also receives the "1" from the voltage regulator bypass signal 718 and turns completely on. At this point, the gate terminal (G1) is pulled to ground through the source terminal (S23) and the drain terminal (D23) which causes gate terminal (G1) of P-FET transistor 120 to turn completely on. Thus, full current will flow through the source terminal (S1) to the drain terminal (D1) which causes the output voltage on primary output node 114 to be at virtual Vdd from voltage source 104.

When voltage regulator bypass signal 718 is not asserted, i.e. a "0", the gate terminal (G18) of P-FET transistor 406 receives the "0" and turns completely on. Also, the gate terminal (G17) of N-FET transistor 404 receives the inverse, a "1", of the not asserted voltage regulator bypass signal 718 through inverter 410, such that the gate terminal (G17) receives the "1" and turns completely on. Thus, the output of operational amplifier 118 is closed to the gate terminal (G1) of P-FET transistor 120 and P-FET transistor 120 operates as described with regard to FIGS. 1-3. Additionally, gate terminal (G23) of N-FET transistor 716 also receives the "0" from voltage regulator bypass signal 718 and turns completely off. At this point, no current flows through the source terminal (S23) through the drain terminal (D23) to ground. Thus, P-FET transistor 120 operates as described with regard to FIGS. 1-3.

Figure 8:
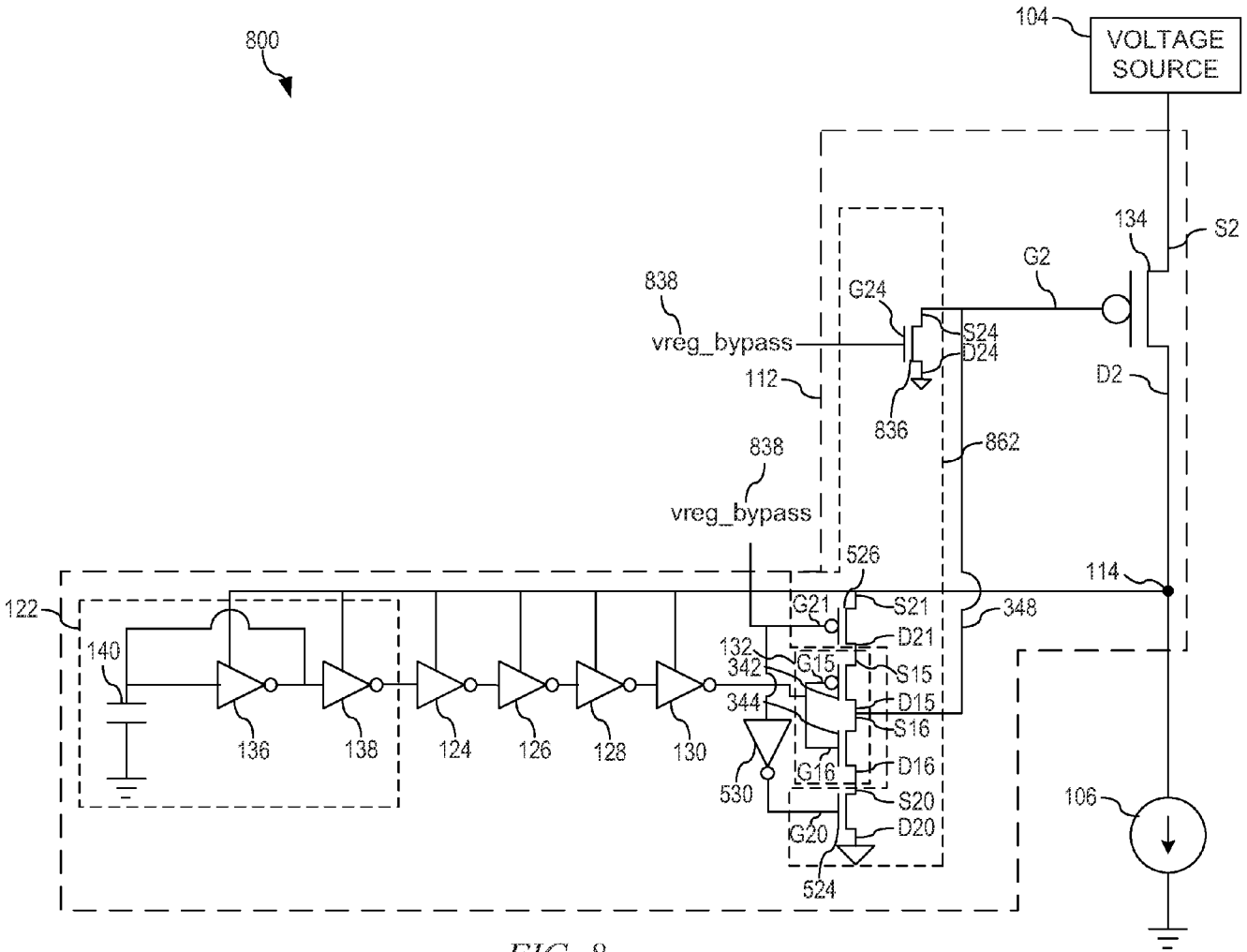
FIG. 8 is an electrical schematic of an electrical system having a voltage regulator with additional control circuitry for completely bypassing or turning on the current supply of a high frequency micro loop circuit 112 of FIG. 1 in accordance with an exemplary embodiment.

FIG. 8 is an electrical schematic of an electrical system having a voltage regulator with additional control circuitry for completely bypassing or turning on the current supply of a high frequency micro loop circuit 112 of FIG. 1 in accordance with an exemplary embodiment. Circuit 800 includes comparator circuit 122, inverters 124, 126, 128, 130, 132, P-FET transistor 134 and control circuitry 862. Circuit 112 includes comparator circuit 122, inverters 124, 126, 128, 130, and 132, and P-FET transistor 134, which operate in the manner described above in FIGS. 1-3 except when control circuitry 862 is activated. Control circuitry 862 is similar to control circuitry 522 of FIG. 5 other than including P-FET transistor 528, rather, control circuitry 862 includes N-FET transistor 836. Thus, control circuitry 862 includes N-FET transistors 524 and 836, P-FET transistors 526, and inverter 530. N-FET transistor 524 has a gate terminal (G20), a source terminal (S20), and a drain terminal (D20). P-FET transistor 526 has a gate terminal (G21), a source terminal (S21), and a drain terminal (D21). N-FET transistor 836 has a gate terminal (G24), a source terminal (S24), and a drain terminal (D24). Instead of the source terminal (S15) of P-FET transistor 342 being electrically coupled to primary output node 114 as is illustrated in FIG. 3, the source terminal (S15) of P-FET transistor 342 is electrically coupled to the drain terminal (D21) of P-FET transistor 526. The source terminal (S21) of P-FET transistor 526 is then electrically coupled to primary output node 114.

Also, instead of the drain terminal (D16) of N-FET transistor 344 being electrically coupled to electrical ground as is illustrated in FIG. 3, the drain terminal (D16) of N-FET transistor 344 is electrically coupled to the source terminal (S20) of N-FET transistor 524. The drain terminal (D20) of N-FET transistor 524 is then electrically coupled to electrical ground. The gate terminal (G21) of P-FET transistor 526 is electrically coupled to voltage regulator bypass (vreg_bypass) signal 838. The gate terminal (G20) is electrically coupled to the output of inverter 530 and the input of inverter 530 is electrically coupled to voltage regulator bypass signal 838. The gate terminal (G24) of N-FET transistor 836 is electrically coupled to voltage regulator bypass signal 838 and the drain terminal (D24) of N-FET transistor 836 is electrically coupled to ground. The source terminal (D24) of N-FET transistor 836 is electrically coupled to the output terminal 348 of inverter 132 and to the gate terminal (G2) of P-FET transistor 134.

When voltage regulator bypass signal 838 is asserted, i.e. a "1", the gate terminal (G21) of P-FET transistor 526 receives the "1" and turns completely off. Also, the gate terminal (G20) of N-FET transistor receives the inverse, a "0", of the asserted voltage regulator bypass signal 838 through inverter 530, such that the gate terminal (G20) receives the "0" and turns completely off. Thus, the output of inverter 132 is floating to the gate terminal (G2) of P-FET transistor 134. Additionally, gate terminal (G24) of N-FET transistor 836 also receives the "1" from voltage regulator bypass signal 838 and turns completely on. At this point, the gate terminal (G2) is pulled to ground through the source terminal (S24) and the drain terminal (D24) which causes gate terminal (G2) of P-FET transistor 134 to turn completely on. Thus, full current will flow through the source terminal (S2) to the drain terminal (D2) which causes the output voltage on primary output node 114 to be at virtual Vdd from voltage source 104.

When voltage regulator bypass signal 838 is not asserted, i.e. a "0", the gate terminal (G21) of P-FET transistor 526 receives the "0" and turns completely on. Also, the gate terminal (G20) of N-FET transistor 524 receives the inverse, a "1", of the not asserted voltage regulator bypass signal 838 through inverter 530, such that the gate terminal (G20) receives the "1" and turns completely on. Thus, the inverter 132 operates as described with regard to FIGS. 1-3. Additionally, gate terminal (G24) of N-FET transistor 836 also receives the "0" from voltage regulator bypass signal 838 and turns completely off. At this point, no current flows through the source terminal (S24) through the drain terminal (D24) to ground. Thus, P-FET transistor 134 operates as described with regard to FIGS. 1-3.

Figure 9:
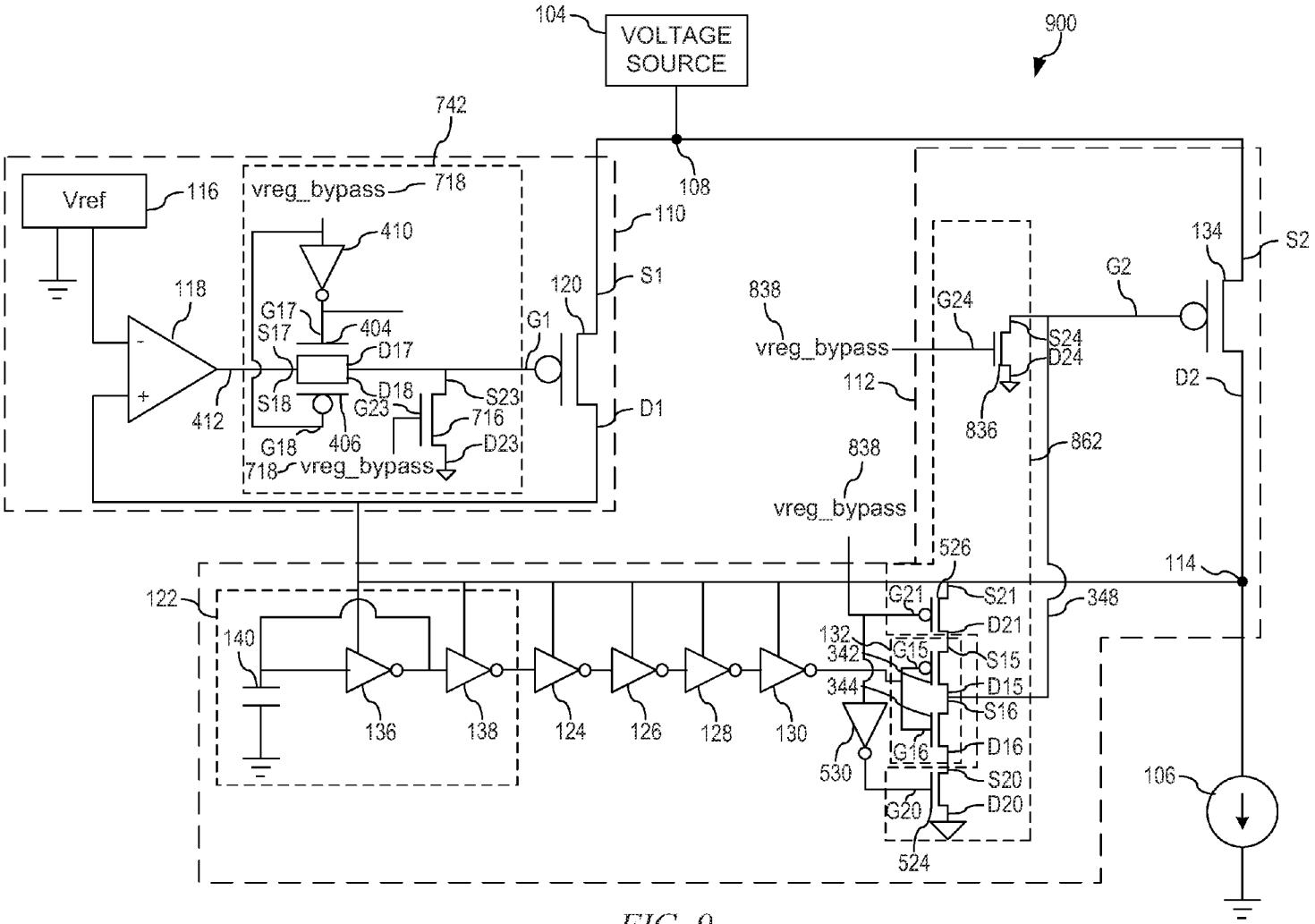
FIG. 9 is an electrical schematic of an electrical system having a voltage regulator with additional control circuitry for completely bypassing or turning on the current supply of a combined low frequency main loop circuit 110 and high frequency micro loop circuit 112 of FIG. 1 in accordance with an exemplary embodiment.

FIG. 9 is an electrical schematic of an electrical system having a voltage regulator with additional control circuitry for completely bypassing or turning on the current supply of a combined low frequency main loop circuit 110 and high frequency micro loop circuit 112 of FIG. 1 in accordance with an exemplary embodiment. Rather than only bypassing or turning on the current supply of a low frequency main loop circuit as is shown in FIG. 7 or only bypassing or turning on the current supply of a high frequency micro loop circuit as is shown in FIG. 8, FIG. 9 bypasses both the low frequency main loop circuit 110 and high frequency micro loop circuit 112 of FIG. 1 at the same time. Electrical system 900 shows control circuitry 742 of FIG. 7 and control circuitry 862 of FIG. 8. When bypassing is desired in electrical system 900, then voltage regulator bypass signal 718 and voltage regulator bypass signal 838, which are the same signal in this illustrative embodiment, are asserted and control circuitry 742 and control circuitry 862 operate in the manner described above in FIGS. 7 and 8. When bypassing is not required, then voltage regulator bypass signal 718 and voltage regulator bypass signal 838 are not asserted and electrical system 900 operates in the manner described in FIG. 1-3.

Figure 10:
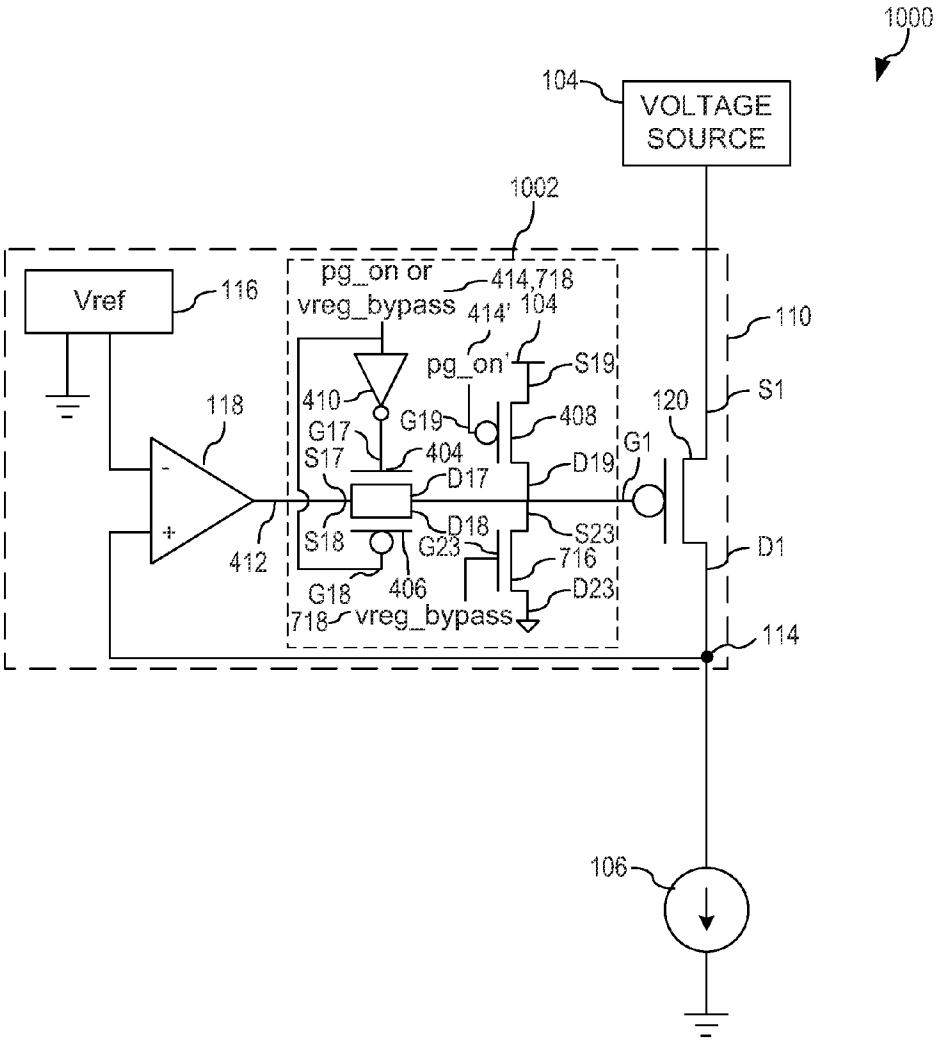
FIG. 10 is an electrical schematic of an electrical system having a voltage regulator with additional control circuitry for either completely power gating or turning off the current supply of a low frequency main loop circuit 110 of FIG. 1 or completely bypassing or turning on the current supply of a low frequency main loop circuit 110 of FIG. 1 in accordance with an exemplary embodiment.

FIG. 10 is an electrical schematic of an electrical system having a voltage regulator with additional control circuitry for either completely power gating or turning off the current supply of a low frequency main loop circuit 110 of FIG. 1 or completely bypassing or turning on the current supply of a low frequency main loop circuit 110 of FIG. 1 in accordance with an exemplary embodiment. Circuit 1000 includes voltage reference device 116, operational amplifier 118, P-FET transistor 120, and control circuitry 1002. Operational amplifier 118, P-FET transistor 120, and voltage reference device 116 operate in the manner described above in FIGS. 1-3 except when control circuitry 1002 is activated. Control circuitry 1002 combines control circuitry 402 of FIG. 4 with the control circuitry 742 of FIG. 7 such that control circuitry 1002 includes N-FET transistors 404 and 716, P-FET transistor 406 and 408, and inverter 410. N-FET transistor 404 has a gate terminal (G17), a source terminal (S17), and a drain terminal (D17). P-FET transistor 406 has a gate terminal (G18), a source terminal (S18), and a drain terminal (D18). P-FET transistor 408 has a gate terminal (G19), a source terminal (S19), and a drain terminal (D19). N-FET transistor 716 has a gate terminal (G23), a source terminal (S23), and a drain terminal (D23). The source terminals (S17) and (S18) are electrically coupled together at input terminal 412.

Input terminal 412 is electrically coupled to the output terminal of operational amplifier 118. The drain terminals (D17) and (D18) are electrically coupled to the drain terminal (D19) of P-FET transistor 408, to the source terminal (S23) of N-FET transistor 716, and to the gate terminal (G1) of P-FET transistor 120. The gate terminal (G18) of P-FET transistor 406 is electrically coupled to an OR function of power gate (pg_on) signal 414 and voltage regulator bypass (vreg_bypass) signal 718. The gate terminal (G17) is electrically coupled to the output of inverter 410 and the input of inverter 410 is electrically coupled to an OR function of power gate signal 414 and voltage regulator bypass signal 718. The gate terminal (G19) of P-FET transistor 408 is electrically coupled to the complement of power gate signal 414 and the source terminal (S19) of P-FET transistor 408 is electrically coupled to voltage source 104. The gate terminal (G23) of N-FET transistor 716 is also electrically coupled to the voltage regulator bypass signal 718 and the drain terminal (D23) of N-FET transistor 716 is electrically coupled to ground.

When power gate signal 414 is asserted, i.e. a "1", the gate terminal (G18) of P-FET transistor 406 receives the "1" and turns completely off. Also, the gate terminal (G17) of N-FET 404 transistor receives the inverse, a "0", of the asserted power gate signal 414 through inverter 410, such that the gate terminal (G17) receives the "0" and turns completely off. Thus, the output of operational amplifier 118 is open to the gate terminal (G1) of P-FET transistor 120. Additionally, gate terminal (G19) of P-FET transistor 408 receives a "0" from the complement of power gate signal 414 and turns completely on. At this point, current from voltage source 104 flows through the source terminal (S19) to the drain terminal (D19) which causes gate terminal (G1) of P-FET transistor 120 to turn completely off. Thus, no current will flow through the source terminal (S1) to the drain terminal (D1) which causes the output voltage on primary output node 114 to float.

When voltage regulator bypass signal 718 is asserted, i.e. a "1", the gate terminal (G18) of P-FET transistor 406 receives the "1" and turns completely off. Also, the gate terminal (G17) of N-FET transistor 404 receives the inverse, a "0", of the asserted voltage regulator bypass signal 718 through inverter 410, such that the gate terminal (G17) receives the "0" and turns completely off. Thus, the output of operational amplifier 118 is open to the gate terminal (G1) of P-FET transistor 120. Additionally, gate terminal (G23) of N-FET transistor 716 also receives the "1" from the voltage regulator bypass signal 718 and turns completely on. At this point, the gate terminal (G1) is pulled to ground through the source terminal (S23) and the drain terminal (D23) which causes gate terminal (G1) of P-FET transistor 120 to turn completely on. Thus, full current will flow through the source terminal (S1) to the drain terminal (D1) which causes the output voltage on primary output node 114 to be at virtual Vdd from voltage source 104.

When power gate signal 414 and voltage regulator bypass signal 718 are both not asserted, i.e. a "0", the gate terminal (G18) of P-FET transistor 406 receives the "0" and turns completely on. Also, the gate terminal (G17) of N-FET transistor 404 receives the inverse, a "1", of the not asserted power gate signal 414 and not asserted voltage regulator bypass signal 718 through inverter 410, such that the gate terminal (G17) receives the "1" and turns completely on. Thus, the output of operational amplifier 118 is closed to the gate terminal (G1) of P-FET transistor 120 and P-FET transistor 120 operates as described with regard to FIGS. 1-3. Additionally, gate terminal (G19) of P-FET transistor 408 also receives a "1" from the complement of power gate signal 414 and turns completely off. At this point, no current flows from voltage source 104 through the source terminal (S19) to the drain terminal (D19). Thus, P-FET transistor 120 operates as described with regard to FIGS. 1-3.

Additionally, gate terminal (G23) of N-FET transistor 716 also receives the "0" from voltage regulator bypass signal 718 and turns completely off. At this point, no current flows through the source terminal (S23) through the drain terminal (D23) to ground. Thus, P-FET transistor 120 operates as described with regard to FIGS. 1-3.

Figure 11:
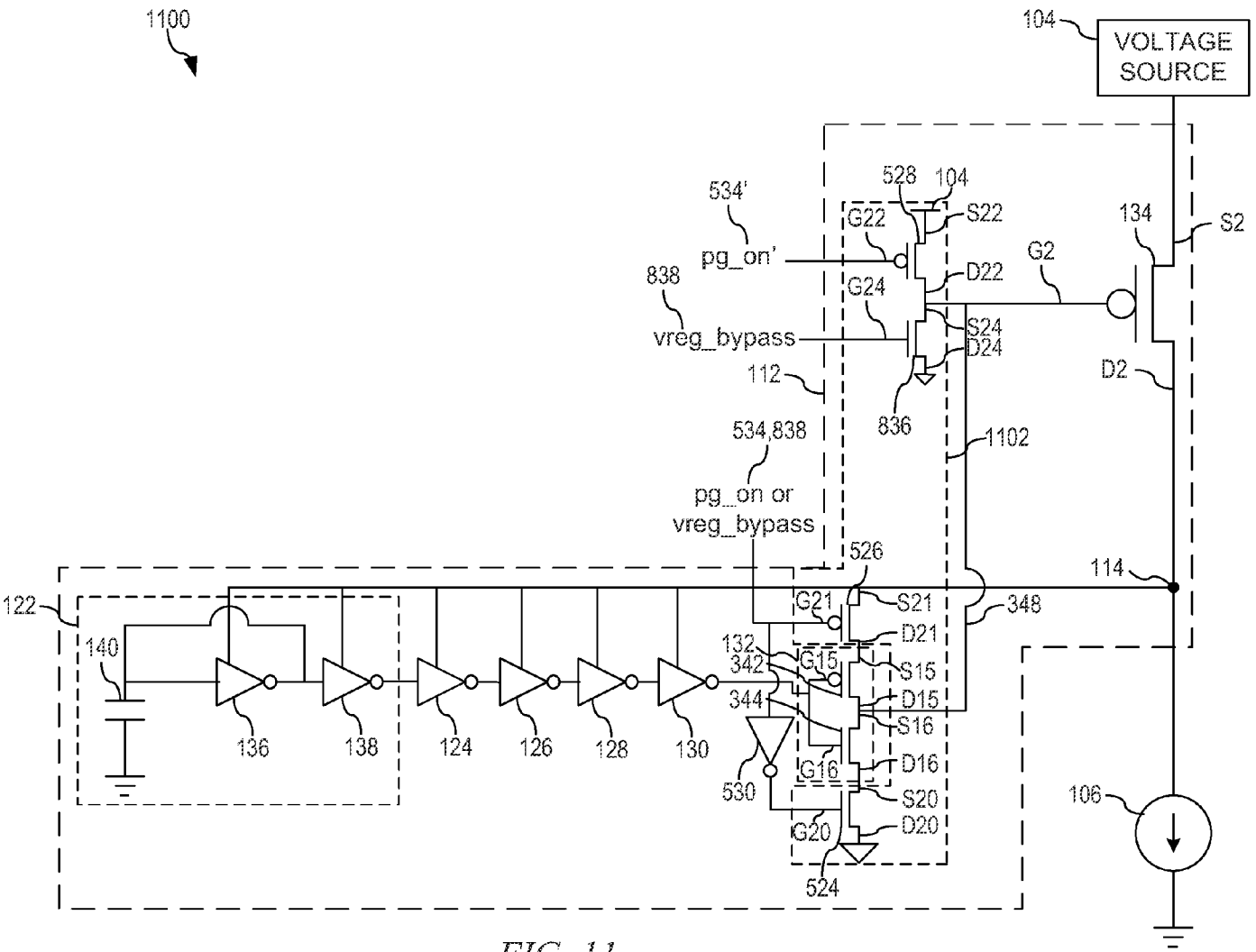
FIG. 11 is an electrical schematic of an electrical system having a voltage regulator with additional control circuitry for completely power gating or turning off the current supply of a high frequency micro loop circuit 112 of FIG. 1 or completely bypassing or turning on the current supply of a high frequency micro loop circuit 112 of FIG. 1 in accordance with an exemplary embodiment.

FIG. 11 is an electrical schematic of an electrical system having a voltage regulator with additional control circuitry for completely power gating or turning off the current supply of a high frequency micro loop circuit 112 of FIG. 1 or completely bypassing or turning on the current supply of a high frequency micro loop circuit 112 of FIG. 1 in accordance with an exemplary embodiment. Circuit 1100 includes comparator circuit 122, inverters 124, 126, 128, 130, 132, P-FET transistor 134 and control circuitry 1102. Circuit 112 includes comparator circuit 122, inverters 124, 126, 128, 130, and 132, and P-FET transistor 134, which operate in the manner described above in FIGS. 1-3 except when control circuitry 1102 is activated. Control circuitry 1102 combines control circuitry 522 of FIG. 5 with the control circuitry 862 of FIG. 8 such that control circuitry 1102 includes N-FET transistors 524 and 836, P-FET transistors 526 and 528, and inverter 530. N-FET transistor 524 has a gate terminal (G20), a source terminal (S20), and a drain terminal (D20). P-FET transistor 526 has a gate terminal (G21), a source terminal (S21), and a drain terminal (D21). P-FET transistor 528 has a gate terminal (G22), a source terminal (S22), and a drain terminal (D22). N-FET transistor 836 has a gate terminal (G24), a source terminal (S24), and a drain terminal (D24). Instead of the source terminal (S15) of P-FET transistor 342 being electrically coupled to primary output node 114 as is illustrated in FIG. 3, the source terminal (S15) of P-FET transistor 342 is electrically coupled to the drain terminal (D21) of P-FET transistor 526. The source terminal (S21) of P-FET transistor 526 is then electrically coupled to primary output node 114.

Also, instead of the drain terminal (D16) of N-FET transistor 344 being electrically coupled to electrical ground as is illustrated in FIG. 3, the drain terminal (D16) of N-FET transistor 344 is electrically coupled to the source terminal (S20) of N-FET transistor 524. The drain terminal (D20) of N-FET transistor 524 is then electrically coupled to electrical ground. The gate terminal (G21) of P-FET transistor 526 is electrically coupled to an OR function of power gate (pg_on) signal 534 and voltage regulator bypass (vreg_bypass) signal 838. The gate terminal (G20) is electrically coupled to the output of inverter 530 and the input of inverter 530 is electrically coupled to an OR function of power gate signal 534 and voltage regulator bypass signal 838. The gate terminal (G22) of P-FET transistor 528 is electrically coupled to the complement of power gate signal 534 and the source terminal (S22) of P-FET transistor 528 is electrically coupled to voltage source 104. The drain terminal (D22) is electrically coupled to the output terminal 348 of inverter 132 and to the gate terminal (G2) of P-FET transistor 134. The gate terminal (G24) of N-FET transistor 836 is electrically coupled to voltage regulator bypass signal 838 and the drain terminal (D24)

of N-FET transistor 836 is electrically coupled to ground. The source terminal (D24) of N-FET transistor 836 is electrically coupled to the output terminal 348 of inverter 132 and to the gate terminal (G2) of P-FET transistor 134.

When power gate signal 534 is asserted, i.e. a "1", the gate terminal (G21) of P-FET transistor 526 receives the "1" and turns completely off. Also, the gate terminal (G20) of N-FET transistor 524 receives the inverse, a "0", of the asserted power gate signal 534 through inverter 530, such that the gate terminal (G20) receives the "0" and turns completely off. Thus, the output of inverter 132 is floating to the gate terminal (G2) of P-FET transistor 134. Additionally, gate terminal (G22) of P-FET transistor 528 also receives the "0" from the complement of power gate signal 534 and turns completely on. At this point, current from voltage source 104 flows through the source terminal (S22) to the drain terminal (D22) which causes gate terminal (G2) of P-FET transistor 134 to turn completely off. Thus, no current will flow through the source terminal (S2) to the drain terminal (D2) which causes the output voltage on primary output node 114 to float.

When voltage regulator bypass signal 838 is asserted, i.e. a "1", the gate terminal (G21) of P-FET transistor 526 receives the "1" and turns completely off. Also, the gate terminal (G20) of N-FET transistor 524 receives the inverse, a "0", of the asserted voltage regulator bypass signal 838 through inverter 530, such that the gate terminal (G20) receives the "0" and turns completely off. Thus, the output of inverter 132 is floating to the gate terminal (G2) of P-FET transistor 134. Additionally, gate terminal (G24) of N-FET transistor 836 also receives the "1" from voltage regulator bypass signal 838 and turns completely on. At this point, the gate terminal (G2) is pulled to ground through the source terminal (S24) and the drain terminal (D24) which causes gate terminal (G2) of P-FET transistor 134 to turn completely on. Thus, full current will flow through the source terminal (S2) to the drain terminal (D2) which causes the output voltage on primary output node 114 to be at virtual Vdd from voltage source 104.

When power gate signal 534 is not asserted, i.e. a "0", the gate terminal (G21) of P-FET transistor 526 receives the "0" and turns completely on. Also, the gate terminal (G20) of N-FET transistor 524 receives the inverse, a "1", of the not asserted power gate signal 534 through inverter 530, such that the gate terminal (G20) receives the "1" and turns completely on. Thus, the inverter 132 operates as described with regard to FIGS. 1-3. Additionally, gate terminal (G22) of P-FET transistor 528 also receives a "1" from the complement of the power gate signal 534 and turns completely off. At this point, no current flows from voltage source 104 though the source terminal (S22) to the drain terminal (D22). Thus, P-FET transistor 134 operates as described with regard to FIGS. 1-3.

When voltage regulator bypass signal 838 is not asserted, i.e. a "0", the gate terminal (G21) of P-FET transistor 526 receives the "0" and turns completely on. Also, the gate terminal (G20) of N-FET transistor 524 receives the inverse, a "1", of the not asserted voltage regulator bypass signal 838 through inverter 530, such that the gate terminal (G20) receives the "1" and turns completely on. Thus, the inverter 132 operates as described with regard to FIGS. 1-3. Additionally, gate terminal (G24) of N-FET transistor 836 also receives the "0" from voltage regulator bypass signal 838 and turns completely off. At this point, no current flows through the source terminal (S24) through the drain terminal (D24) to ground. Thus, P-FET transistor 134 operates as described with regard to FIGS. 1-3.

Figure 12:
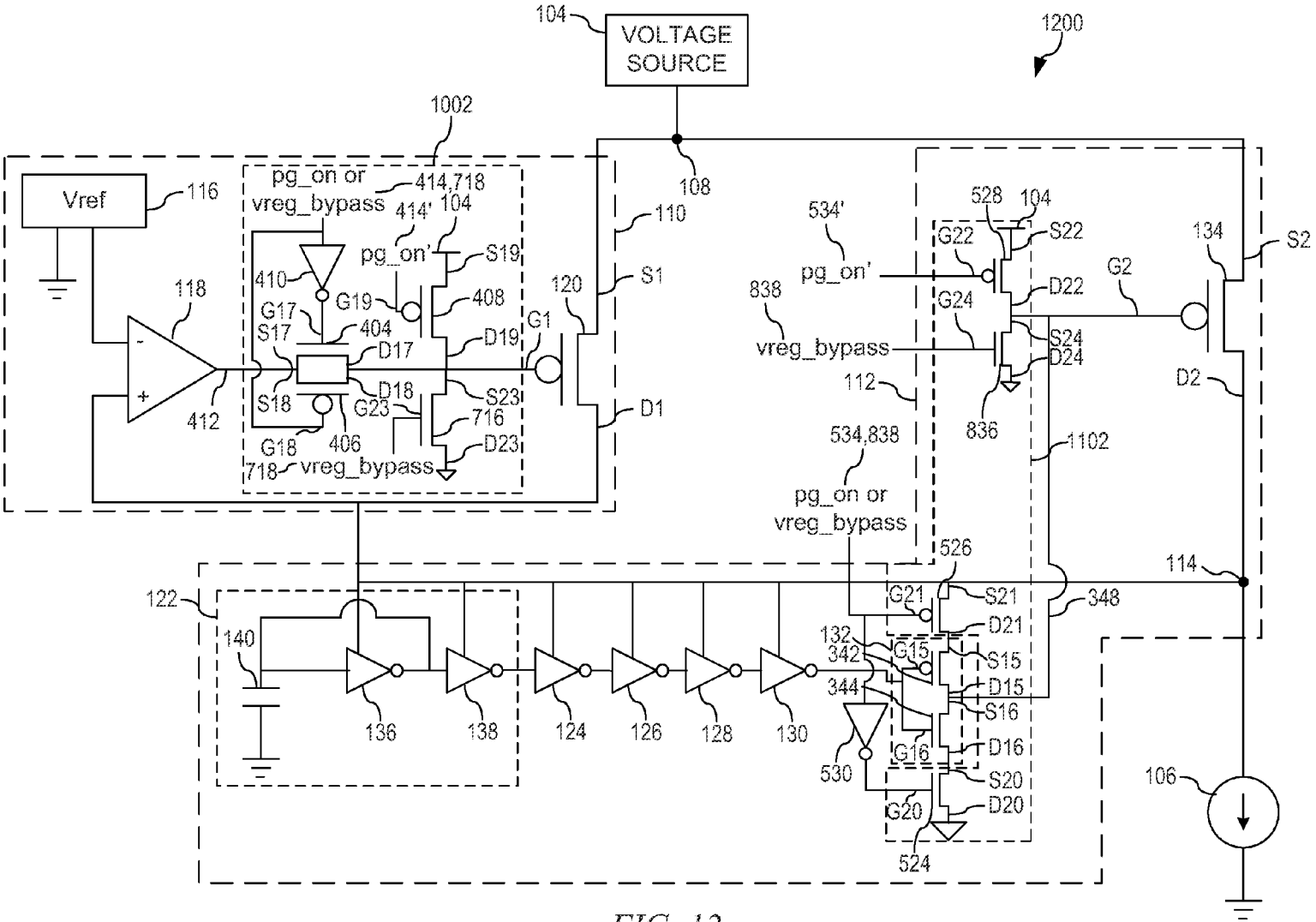
FIG. 12 is an electrical schematic of an electrical system having a voltage regulator with additional control circuitry for either completely power gating or turning off the current supply of a combined low frequency main loop circuit 110 and high frequency micro loop circuit 112 of FIG. 1 or completely bypassing or turning on the current supply of a combined low frequency main loop circuit 110 and high frequency micro loop circuit 112 of FIG. 1 in accordance with an exemplary embodiment.

FIG. 12 is an electrical schematic of an electrical system having a voltage regulator with additional control circuitry for either completely power gating or turning off the current supply of a combined low frequency main loop circuit 110 and high frequency micro loop circuit 112 of FIG. 1 or completely bypassing or turning on the current supply of a combined low frequency main loop circuit 110 and high frequency micro loop circuit 112 of FIG. 1 in accordance with an exemplary embodiment. Rather than only power gating or turning off, or bypassing or turning on, the current supply of a low frequency main loop circuit as is shown in FIG. 10, power gating or turning off, or bypassing or turning on, the current supply of a high frequency micro loop circuit as is shown in FIG. 11, FIG. 12 provides for power gating both the low frequency main loop circuit 110 and high frequency micro loop circuit 112 of FIG. 1 at the same time or bypassing both the low frequency main loop circuit 110 and high frequency micro loop circuit 112 of FIG. 1 at the same time. Electrical system 1200 shows circuit 1002 of FIG. 10 and circuit 1102 of FIG. 11.

When power gating is desired in electrical system 1200, then power gate signal 414 and power gate signal 534, which are the same signal in this illustrative embodiment, are asserted and control circuitry 1002 and control circuitry 1102 operate in the manner described above in FIGS. 10 and 11. When bypassing is desired in electrical system 1200, then voltage regulator bypass signal 718 and voltage regulator bypass signal 838, which are the same signal in this illustrative embodiment, are asserted and control circuitry 1002 and control circuitry 1102 operate in the manner described above in FIGS. 10 and 11. When neither power gating nor bypassing is required, then none of power gate signal 414, power gate signal 534, voltage regulator bypass signal 718, nor voltage regulator bypass signal 838 are asserted and electrical system 1200 operates in the manner described in FIG. 1-3.

Figure 13:
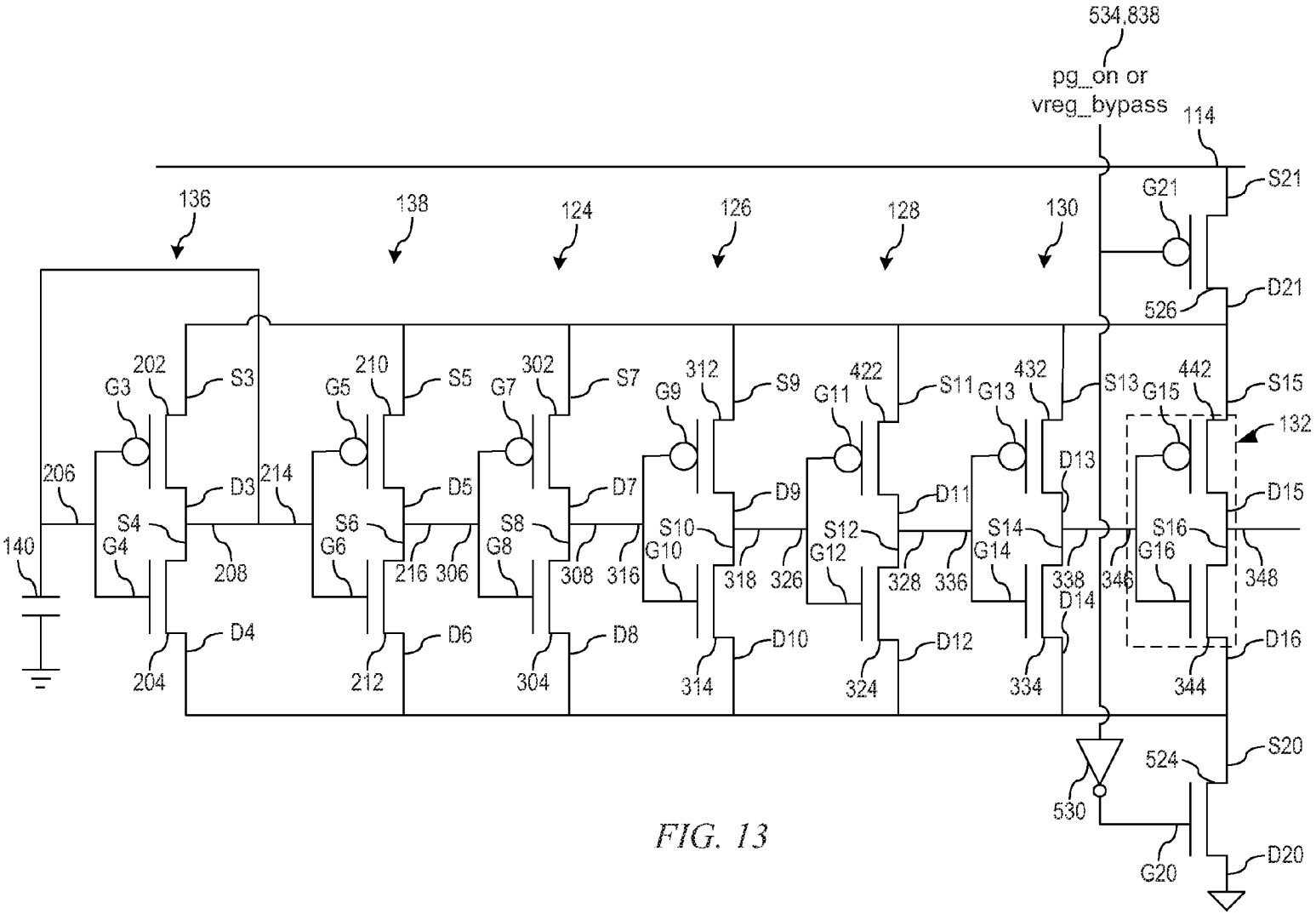
FIG. 13 depicts an alternative electrical schematic of a plurality of inverters utilized in the voltage regulator of FIGS. 2, 3, and 12 in accordance with an illustrative embodiment.

FIG. 13 depicts an alternative electrical schematic of a plurality of inverters utilized in the voltage regulator of FIGS. 2, 3, and 12 in accordance with an illustrative embodiment. In order to further reduce leakage power when in power gated or bypass mode, the illustrative embodiments provide for electrically connecting the drain terminal (D21) of P-FET transistor 526 and the source terminal (S20) of N-FET transistor 524 to the respective source and drain terminals of inverters 136, 138, 124, 126, 128, and 130 (in addition to inverter 132). Any short-circuit current from primary output node 114 to ground through the P-FET and N-FET transistors within inverters 136, 138, 124, 126, 128, 130, and 132 is thus cut off when in power gated or bypass mode providing power savings. That is, the drain terminal (D21) of P-FET transistor 526 is electrically connected to one or more of the source terminals S3, S5, S7, S9, S11, and S13 of P-FET transistors 202, 210, 302, 312, 422, and 432 of inverters 136, 138, 124, 126, 128, and 130, respectively. Additionally, the source terminal (S20) of N-FET transistor 524 would be electrically connected to one or more of the drain terminals D4, D6, D8, D10, D12, and D14 of N-FET transistors 204, 212, 304, 314, 324, and 334 of inverters 136, 138, 124, 126, 128, and 130, respectively.

Figure 14:
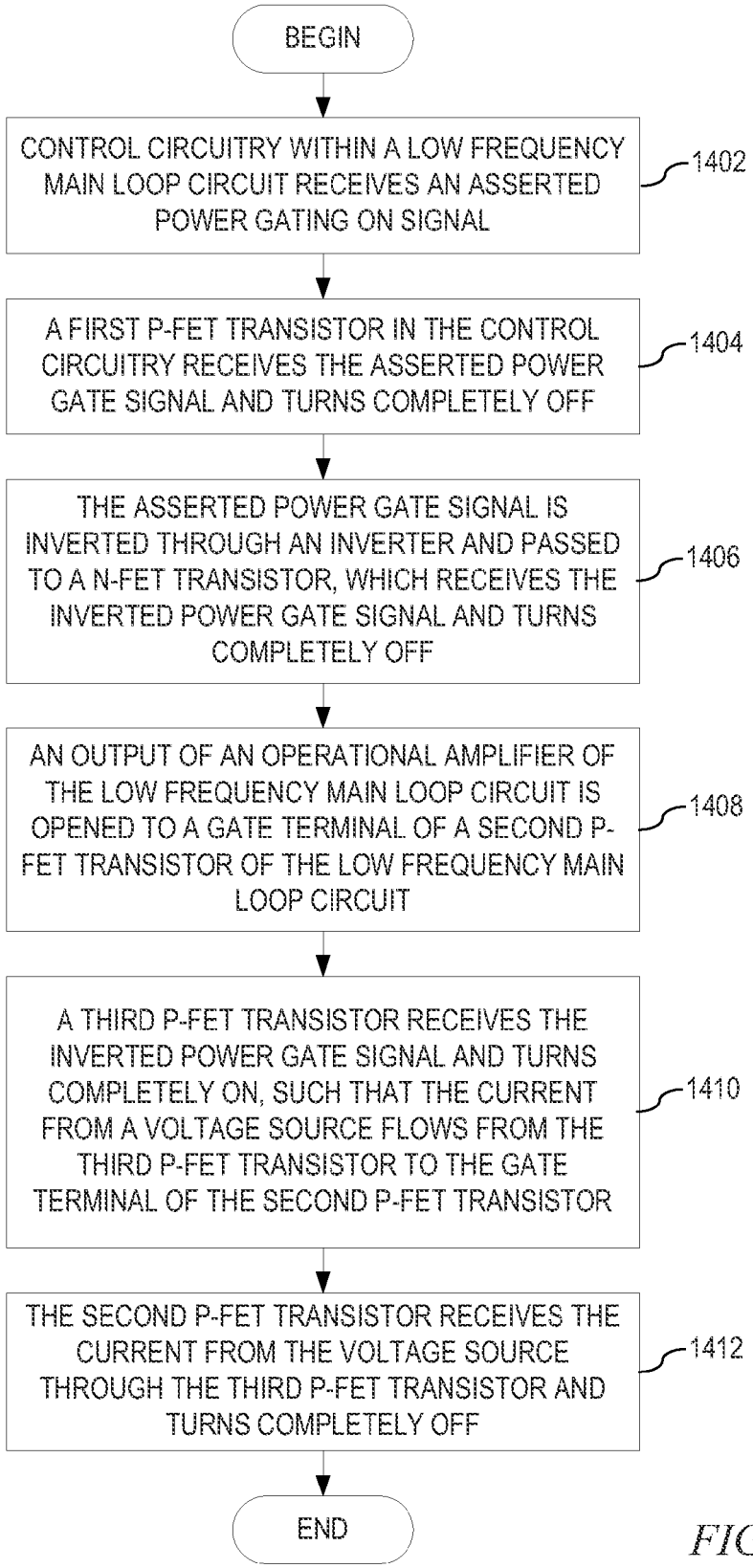
FIG. 14 depicts a flowchart for completely power gating or turning off the current supply of a low frequency main loop circuit in accordance with an illustrative embodiment.

Referring now to FIGS. 14-17, these figures provide flowcharts outlining example operations performed by mechanisms where a voltage regulator module (VRM) circuit may be extended with the functionality to override the senseamp output to provide either full-on or full-off current supply capability. FIG. 14 depicts a flowchart for completely power gating or turning off the current supply of a low frequency main loop circuit in accordance with an illustrative embodiment. As the operation begins, control circuitry within the low frequency main loop circuit receives an asserted power gating on signal (step 1402). A first P-FET transistor in the control circuitry receives the asserted power gate signal and turns completely off (step 1404). The asserted power gate signal is inverted through an inverter and passed to a N-FET transistor, which receives the inverted power gate signal and turns completely off (step 1406). By the first P-FET transistor and the N-FET transistor turning completely off, an output of an operational amplifier of the low frequency main loop circuit is opened to a gate terminal of a second P-FET transistor of the low frequency main loop circuit (step 1408). A third P-FET transistor also receives the inverted power gate signal and turns completely on, such that current from a voltage source flows from the third P-FET transistor to the gate terminal of the second P-FET transistor (step 1410). The second P-FET transistor receives the current from the voltage source through the third P-FET transistor and turns completely off (step 1412), with the operation ending thereafter. Thus, no current will flow from the source terminal to the drain terminal of the second P-FET transistor which causes the output voltage on primary output node to float.

Figure 15:
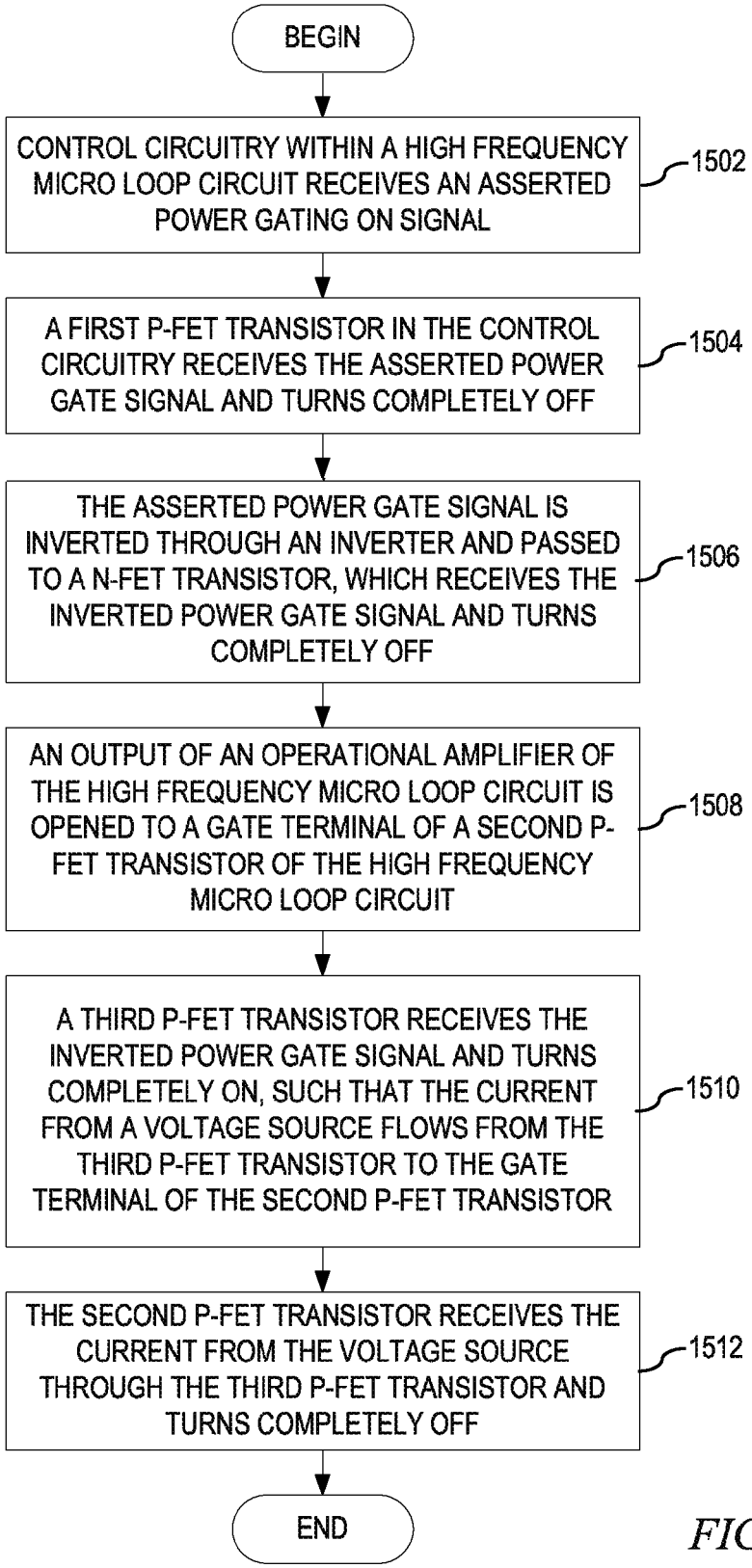
FIG. 15 depicts a flowchart for completely power gating or turning off the current supply of a high frequency micro loop circuit in accordance with an illustrative embodiment.

FIG. 15 depicts a flowchart for completely power gating or turning off the current supply of a high frequency micro loop circuit in accordance with an illustrative embodiment. As the operation begins, control circuitry within the high frequency micro loop circuit receives an asserted power gating on signal (step 1502). A first P-FET transistor receives the asserted power gate signal and turns completely off (step 1504). The asserted power gate signal is inverted through an inverter and passed to a N-FET transistor, which receives the inverted power gate signal and turns completely off (step 1506). By the first P-FET transistor and the N-FET transistor turning completely off, an output of an operational amplifier of the high frequency micro loop circuit is floating to a gate terminal of a second P-FET transistor of the high frequency micro loop circuit (step 1508). A third P-FET transistor also receives the inverted power gate signal and turns completely on, such that current from a voltage source flows from the third P-FET transistor to the gate terminal of the second P-FET transistor (step 1510). The second P-FET transistor receives current from the voltage source through the third P-FET transistor and turns completely off (step 1512), with the operation ending thereafter. Thus, no current will flow from the source terminal to the drain terminal of the second P-FET transistor which causes the output voltage on primary output node to float.

Figure 16:
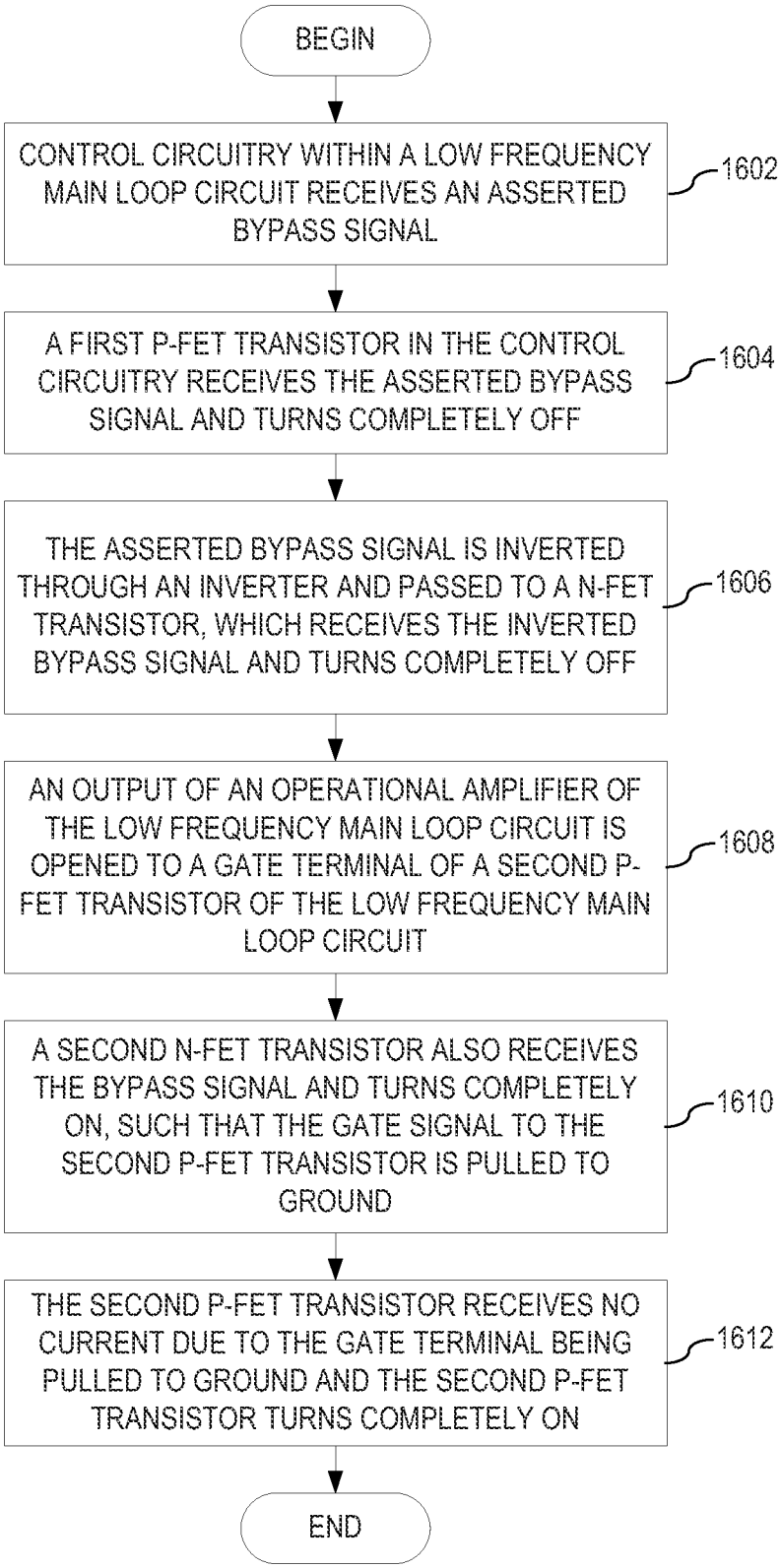
FIG. 16 depicts a flowchart for completely bypassing or turning on the current supply of a low frequency main loop circuit in accordance with an illustrative embodiment.

FIG. 16 depicts a flowchart for completely bypassing or turning on the current supply of a low frequency main loop circuit in accordance with an illustrative embodiment. As the operation begins, control circuitry within the low frequency main loop circuit receives an asserted bypass signal (step 1602). A first P-FET transistor in the control circuitry receives the asserted bypass signal and turns completely off (step 1604). The asserted bypass signal is inverted through an inverter and passed to a N-FET transistor, which receives the inverted bypass signal and turns completely off (step 1606). By the first P-FET transistor and the N-FET transistor turning completely off, an output of an operational amplifier of the low frequency main loop circuit is opened to a gate terminal of a second P-FET transistor of the low frequency main loop circuit (step 1608). A second N-FET transistor also receives the bypass signal and turns completely on, such that the gate signal to the second P-FET transistor is pulled to ground (step 1610). By the second P-FET transistor receiving no current due to the gate terminal being pulled to ground, the second P-FET transistor turns completely on (step 1612), with the operation ending thereafter. Thus, full current will flow from the source terminal to the drain terminal of the second P-FET transistor, which causes the output voltage on primary output node to be at virtual Vdd from a voltage source.

Figure 17:
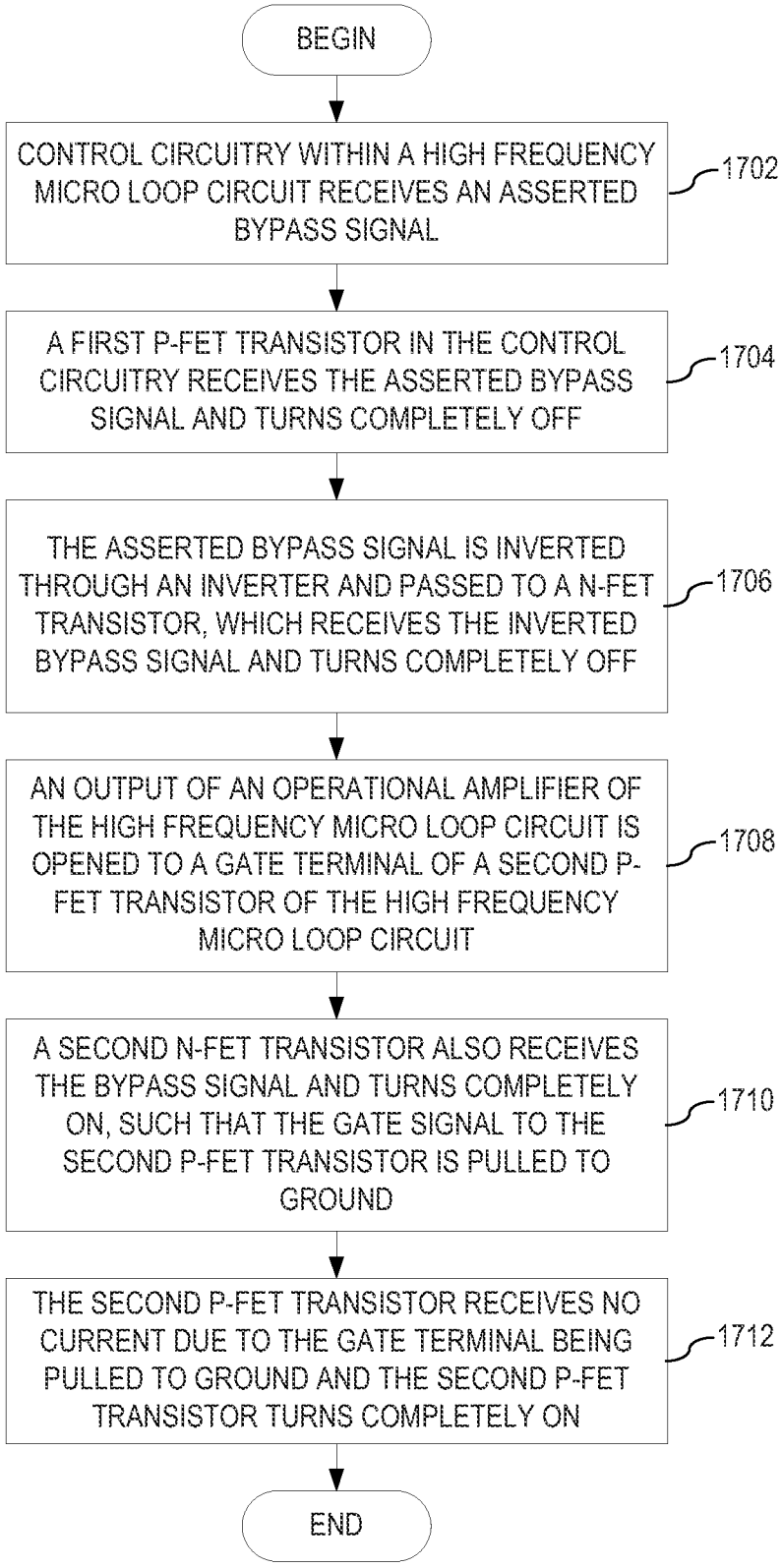
FIG. 17 depicts a flowchart for completely bypassing or turning on the current supply of a high frequency micro loop circuit in accordance with an illustrative embodiment.

FIG. 17 depicts a flowchart for completely bypassing or turning on the current supply of a high frequency micro loop circuit in accordance with an illustrative embodiment. As the operation begins, control circuitry within a high frequency micro loop circuit receives an asserted bypass signal (step 1702). A first P-FET transistor receives the asserted bypass signal and turns completely off (step 1704). The asserted bypass signal is inverted through an inverter and passed to a N-FET transistor, which receives the inverted bypass signal and turns completely off (step 1706). By the first P-FET transistor and the N-FET transistor turning completely off, an output of an operational amplifier of the high frequency micro loop circuit is floating to a gate terminal of a second P-FET transistor of the high frequency micro loop circuit (step 1708). A second N-FET transistor also receives the bypass signal and turns completely on, such that the gate signal to the second P-FET transistor is pulled to ground (step 1710). By the second P-FET transistor receiving no current due to the gate terminal being pulled to ground, the second P-FET transistor turns completely on (step 1712), with the operation ending thereafter. Thus, full current will flow from the source terminal to the drain terminal of the second P-FET transistor, which causes the output voltage on primary output node to be at virtual Vdd from a voltage source.

The flowchart and block diagrams in the figures illustrate the architecture, functionality, and operation of possible implementations of systems, methods and computer program products according to various embodiments of the present invention. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

Thus, the illustrative embodiments provide mechanisms where a voltage regulator module (VRM) circuit may be extended with the functionality to override the senseamp output to provide either full-on or full-off current supply capability. The invention adds a control circuit on the path between the senseamp and the current supply device. The control circuit controls whether the senseamp output is to be used to regulate the current supply device or whether the senseamp output should be ignored. If the senseamp output is ignored, then the control circuit can either turn the current supply device fully on or fully off, causing it to act as a power gating header device.

The description of the present invention has been presented for purposes of illustration and description, and is not intended to be exhaustive or limited to the invention in the form disclosed. Many modifications and variations will be apparent to those of ordinary skill in the art. The embodiment was chosen and described in order to best explain the principles of the invention, the practical application, and to enable others of ordinary skill in the art to understand the invention for various embodiments with various modifications as are suited to the particular use contemplated.

What is claimed is:

1. A circuit structure for power gating a voltage regulator, comprising:

first control circuitry, in a first circuit of the voltage regulator, configured to remove frequency components of an output voltage in a first frequency range, wherein the first control circuitry receives a first signal to power gate the output voltage of the first circuit, wherein by the first control circuitry power gating the output voltage of the first circuit causes substantially no voltage to be output by the first circuit to a primary output node, and wherein the first control circuitry comprises:

a N-FET transistor having a source terminal, a drain terminal, and a gate terminal;

a first P-FET transistor having a source terminal, a drain terminal, and a gate terminal; and a second P-FET transistor having a source terminal, a drain terminal, and a gate terminal, wherein:

the source terminal of the N-FET transistor is electrically coupled to the source terminal of the first P-FET transistor, the source terminal of the N-FET transistor and the source terminal of the first P-FET transistor are electrically coupled to an output terminal of an operational amplifier of the first circuit, the drain terminal of the N-FET transistor is electrically coupled to the drain terminal of the first P-FET transistor, the drain terminal of the N-FET transistor and the drain terminal of the first P-FET transistor are further electrically coupled to the drain terminal of the second P-FET transistor, the drain terminal of the N-FET transistor, the drain terminal of the first P-FET transistor, and the drain terminal of the second P-FET transistor are electrically coupled to a gate terminal of a P-FET transistor of the first circuit, the gate terminal of the N-FET transistor is electrically coupled to an output terminal of an inverter, the inverter having an input terminal and the output terminal, the gate terminal of the N-FET transistor and the output terminal of the inverter are electrically coupled to the gate terminal of the second P-FET transistor, the gate terminal of the first P-FET transistor is electrically coupled to the input terminal of the inverter, the gate terminal of the first P-FET transistor and the input terminal of the inverter are electrically coupled to the first signal, and the source terminal of the second P-FET transistor is electrically coupled to the voltage source; and second control circuitry, in a second circuit of the voltage regulator, electrically coupled to the primary output node of the first circuit, the second circuit configured to remove frequency components of the output voltage in a second frequency range, wherein the second frequency range being greater than the first frequency range, wherein the second control circuitry receives the first signal to power gate the output voltage of the second circuit, and wherein by the second control circuitry power gating the output voltage of the second circuit causes substantially no voltage to be output by the second circuit to the primary output node.

2. The circuit structure of claim 1, wherein the first circuit comprises:

the operational amplifier having an inverting input terminal "−", a non-inverting input terminal "+", and the output terminal, wherein the inverting input terminal "−" is electrically coupled to a voltage reference and wherein the non-inverting input terminal "+" is electrically coupled to the primary output node;

the P-FET transistor of the first circuit having a source terminal, a drain terminal, and the gate terminal, wherein the source terminal of the P-FET transistor of the first circuit is electrically coupled to the voltage source, wherein the drain terminal of the P-FET transistor of the first circuit is electrically coupled to the primary output node, and wherein the primary output node is electrically coupled to a load.

3. The circuit structure of claim 1, wherein the second control circuitry comprises:

a N-FET transistor having a source terminal, a drain terminal, and a gate terminal;

a first P-FET transistor having a source terminal, a drain terminal, and a gate terminal; and a second P-FET transistor having a source terminal, a drain terminal, and a gate terminal, wherein:

the source terminal of the N-FET transistor is electrically coupled to a first inverter in the second circuit, the drain terminal of the N-FET transistor is electrically coupled to electrical ground, the source terminal of the first P-FET transistor is electrically coupled to the primary output node, the drain terminal of the first P-FET transistor is electrically coupled to the first inverter, the gate terminal of the N-FET transistor is electrically coupled to an output terminal of a second inverter in the second circuit, the second inverter having an input terminal and the output terminal, the gate terminal of the first P-FET transistor is electrically coupled to the input terminal of the second inverter, the gate terminal of the first P-FET transistor and the input terminal of the second inverter are further electrically coupled to the first signal, the source terminal of the second P-FET transistor is electrically coupled to the voltage source, the drain terminal of the second P-FET transistor is electrically coupled to a gate terminal of a P-FET transistor of the second circuit, the drain terminal of the second P-FET transistor and the gate terminal of the P-FET transistor of the second circuit are further electrically coupled to an output of the first inverter, and the gate terminal of the second P-FET transistor is electrically coupled to a complement of the first signal.

4. The circuit structure of claim 3, wherein the first inverter of the second circuit comprises:

a P-FET transistor having a source terminal, a drain terminal, and a gate terminal;

a N-FET transistor having a source terminal, a drain terminal, and a gate terminal; wherein:

the source terminal of the P-FET transistor is electrically coupled to the drain terminal of the first P-FET transistor of the second control circuitry, the drain terminal of the P-FET transistor is electrically coupled to the source terminal of the N-FET transistor, thereby forming the output of the inverter, the drain of the N-FET transistor is electrically coupled to the source of the N-FET transistor of the second control circuitry, the gate of the P-FET transistor is electrically coupled to the gate of the N-FET transistor, and the gate of the P-FET transistor and the gate of the N-FET transistor are further electrically coupled to an output terminal of a comparator circuit in the second circuit.

5. The circuit structure of claim 4, wherein the gate of the P-FET transistor and the gate of the N-FET transistor are further electrically coupled to an output terminal of a comparator circuit in the second circuit through at least one other inverter.

6. The circuit structure of claim 4, wherein the comparator circuit comprises:

a first inverter having an input terminal and an output terminal, wherein the input terminal is electrically coupled to the output terminal, wherein the input terminal is further electrically coupled to a capacitor that is further coupled to electrical ground, wherein the first inverter is further electrically coupled to the primary output node; and a second inverter having an input terminal and an output terminal, wherein the input terminal is electrically coupled to the output terminal of the first inverter, wherein the second inverter is further electrically coupled to the primary output node, and wherein the output terminal of the second inverter is electrically coupled to the gate of the P-FET transistor and the gate of the N-FET transistor in the second control circuitry.

7. The circuit structure of claim 3, wherein the P-FET transistor of the second circuit comprises:

a source terminal, a drain terminal, and the gate terminal, wherein the source terminal of the P-FET transistor of the second circuit is electrically coupled to the voltage source, wherein the drain terminal of the P-FET transistor of the second circuit is electrically coupled to the primary output node, and wherein the primary output node is electrically coupled to a load.

8. A circuit structure for bypassing a voltage regulator, comprising:

first control circuitry, in a first circuit of the voltage regulator, configured to remove frequency components of an output voltage in a first frequency range, wherein the first control circuitry receives a first signal to bypass the output voltage of the first circuit, wherein by the first control circuitry bypassing the output voltage of the first circuit causes substantially the voltage of a voltage source to be output by the first circuit to a primary output node, and wherein the first control circuitry comprises:

a first N-FET transistor having a source terminal, a drain terminal, and a gate terminal;

a second N-FET transistor having a source terminal, a drain terminal, and a gate terminal; and a P-FET transistor having a source terminal, a drain terminal, and a gate terminal, wherein:

the source terminal of the first N-FET transistor is electrically coupled to the source terminal of the P-FET transistor, the source terminal of the first N-FET transistor and the source terminal of the P-FET transistor are electrically coupled to an output terminal of an operational amplifier of the first circuit, the drain terminal of the first N-FET transistor is electrically coupled to the drain terminal of the P-FET transistor, the drain terminal of the first N-FET transistor and the drain terminal of the P-FET transistor are further electrically coupled to the source terminal of the second N-FET transistor, the drain terminal of the first N-FET transistor, the drain terminal of the P-FET transistor, and the source terminal of the second N-FET transistor are electrically coupled to a gate terminal of a P-FET transistor of the first circuit, the gate terminal of the first N-FET transistor is electrically coupled to an output terminal of an inverter, the inverter having an input terminal and the output terminal, the gate terminal of the P-FET transistor is electrically coupled to the input terminal of the inverter, the gate terminal of the P-FET transistor, the input terminal of the inverter, and the gate terminal of the second N-FET transistor are electrically coupled to the first signal, and the drain terminal of the second N-FET transistor is electrically coupled to electrical ground; and second control circuitry, in a second circuit of the voltage regulator, electrically coupled to the primary output node of the first circuit, the second circuit configured to remove frequency components of the output voltage in a second frequency range, wherein the second frequency range being greater than the first frequency range, wherein the second control circuitry receives the first signal to bypass the output voltage of the second circuit, and wherein by the second control circuitry bypassing the output voltage of the second circuit causes substantially the voltage the of the voltage source be output by the second circuit to the primary output node.

9. The circuit structure of claim 8, wherein the first circuit comprises:

the operational amplifier having an inverting input terminal "−", a non-inverting input terminal "+", and the output terminal, wherein the inverting input terminal "−" is electrically coupled to a voltage reference and wherein the non-inverting input terminal "+" is electrically coupled to the primary output node;

the P-FET transistor of the first circuit having a source terminal, a drain terminal, and the gate terminal, wherein the source terminal of the P-FET transistor of the first circuit is electrically coupled to the voltage source, wherein the drain terminal of the P-FET transistor of the first circuit is electrically coupled to the primary output node, and wherein the primary output node is electrically coupled to a load.

10. The circuit structure of claim 8, wherein the second control circuitry comprises:

a first N-FET transistor having source terminal, a drain terminal, and a gate terminal;

a second N-FET transistor having a source terminal, a drain terminal, and a gate terminal; and a P-FET transistor having a source terminal, a drain terminal, and a gate terminal, wherein:

the source terminal of the first N-FET transistor is electrically coupled to an first inverter in the second circuit, the drain terminal of the first N-FET transistor is electrically coupled to electrical ground, the source terminal of the P-FET transistor is electrically coupled to the primary output node, the drain terminal of the P-FET transistor is electrically coupled to the first inverter, the gate terminal of the first N-FET transistor is electrically coupled to an output terminal of a second inverter in the second circuit, the second inverter having an input terminal and the output terminal, the gate terminal of the P-FET transistor is electrically coupled to the input terminal of the second inverter, the gate terminal of the P-FET transistor, the input terminal of the second inverter, and the gate terminal of the second N-FET transistor are further electrically coupled to the first signal, the source terminal of the second N-FET transistor is electrically coupled to a gate terminal of a P-FET transistor of the second circuit, the source terminal of the second N-FET transistor and the gate terminal of the P-FET transistor of the second circuit are further electrically coupled to an output of the first inverter, and the drain terminal of the second N-FET transistor is electrically coupled to electrical ground.

11. The circuit structure of claim 10, wherein the inverter of the second circuit comprises:

a P-FET transistor having a source terminal, a drain terminal, and a gate terminal;

a N-FET transistor having a source terminal, a gate terminal, and a gate terminal; wherein:

the source terminal of the P-FET transistor is electrically coupled to the drain terminal of the P-FET transistor of the second control circuitry, the drain terminal of the P-FET transistor is electrically coupled to the source terminal of the N-FET transistor, thereby forming the output of the inverter, the drain of the N-FET transistor is electrically coupled to the source of the first N-FET transistor of the second control circuitry, the gate of the P-FET transistor is electrically coupled to the gate of the N-FET transistor, and the gate of the P-FET transistor and the gate of the N-FET transistor are further electrically coupled to an output terminal of a comparator circuit in the second circuit.

12. The circuit structure of claim 11, wherein the gate of the P-FET transistor and the gate of the N-FET transistor are further electrically coupled to an output terminal of a comparator circuit in the second circuit through at least one other inverter.

13. The circuit structure of claim 11, wherein the comparator circuit comprises:

a first inverter having an input terminal and an output terminal, wherein the input terminal is electrically coupled to the output terminal, wherein the input terminal is further electrically coupled to a capacitor that is further coupled to electrical ground, wherein the first inverter is further electrically coupled to the primary output node; and a second inverter having an input terminal and an output terminal, wherein the input terminal is electrically coupled to the output terminal of the first inverter, wherein the second inverter is further electrically coupled to the primary output node, and wherein the output terminal of the second inverter is electrically coupled to the gate of the P-FET transistor and the gate of the N-FET transistor in the second control circuitry.

14. The circuit structure of claim 10, wherein the P-FET transistor of the second circuit comprises:

a source terminal, a drain terminal, and the gate terminal, wherein the source terminal of the P-FET transistor of the second circuit is electrically coupled to the voltage source, wherein the drain terminal of the P-FET transistor of the second circuit is electrically coupled to the primary output node, and wherein the primary output node is electrically coupled to a load.

15. A circuit structure for either power gating or bypassing a voltage regulator, comprising:

first control circuitry, in a first circuit of the voltage regulator, configured to remove frequency components of an output voltage in a first frequency range, wherein the first control circuitry receives either a power gate signal or a bypass signal to either power gate or bypass the output voltage of the first circuit, wherein, responsive to the power gate signal being asserted to power gate the output voltage, the first control circuitry power gates the output voltage of the first circuit such that substantially no voltage is output by the first circuit to a primary output node, wherein, responsive to the bypass signal being asserted to bypass the output voltage, the first control circuitry bypasses the output voltage of the first circuit such that substantially the voltage of the voltage source is output by the first circuit to the primary output node, and wherein the first control circuitry comprises:

a first N-FET transistor having a source terminal, a drain terminal, and a gate terminal;

a second N-FET transistor having a source terminal, a drain terminal, and a gate terminal;

a first P-FET transistor having a source terminal, a drain terminal, and a gate terminal; and a second P-FET transistor having a source terminal, a drain terminal, and a gate terminal, wherein:

the source terminal of the first N-FET transistor is electrically coupled to the source terminal of the first P-FET transistor, the source terminal of the first N-FET transistor and the source terminal of the first P-FET transistor are electrically coupled to an output terminal of an operational amplifier of the first circuit, the drain terminal of the first N-FET transistor is electrically coupled to the drain terminal of the first P-FET transistor, the drain terminal of the first N-FET transistor and the drain terminal of the first P-FET transistor are further electrically coupled to the drain terminal of the second P-FET transistor and the source terminal of the second N-FET transistor, the drain terminal of the first N-FET transistor, the drain terminal of the first P-FET transistor, and the drain terminal of the second P-FET transistor, and the source terminal of the second N-FET transistor are electrically coupled to a gate terminal of a P-FET transistor of the first circuit, the gate terminal of the first N-FET transistor is electrically coupled to an output terminal of an inverter, the inverter having an input terminal and the output terminal, the gate terminal of the first P-FET transistor is electrically coupled to the input terminal of the inverter, the gate terminal of the first P-FET transistor and the input terminal of the inverter are electrically coupled to an OR function of the power gate signal and the bypass signal, the source terminal of the second P-FET transistor is electrically coupled to the voltage source, the gate terminal of the second P-FET transistor is electrically coupled to the complement of the power gate signal, the gate terminal of the second N-FET transistor is electrically coupled to the bypass signal, and the drain terminal of the second N-FET transistor is electrically coupled to electrical ground; and second control circuitry, in a second circuit of the voltage regulator, electrically coupled to the primary output node of the first circuit, the second circuit configured to remove frequency components of the output voltage in a second frequency range, wherein the second control circuitry receives either the power gate signal or th bypass signal to either power gate or bypass the output voltage of the first circuit, wherein responsive to the power gate signal being asserted to power gate the output voltage, the second control circuitry power gates the output voltage of the first circuit such that substantially no voltage is output by the first circuit to the primary output node, and wherein, responsive to the bypass signal being asserted to the bypass the output voltage, the second control circuitry bypasses the output voltage of the first circuit such that substantially the voltage the of the voltage source be output by the first circuit to the primary output node.

16. The circuit structure of claim 15, wherein the second control circuitry comprises:

a first N-FET transistor having a source terminal, a drain terminal, and a gate terminal;

a second N-FET transistor having a source terminal, a drain terminal, and a gate terminal;

a first P-FET transistor having a source terminal, a drain terminal, and a gate terminal; and a second P-FET transistor having a source terminal a drain terminal, and a gate terminal, wherein:

the source terminal of the first N-FET transistor is electrically coupled to a first inverter in the second circuit, the drain terminal of the first N-FET transistor is electrically coupled to ground, the source terminal of the first P-FET transistor is electrically coupled to the primary output node, the drain terminal of the first P-FET transistor is electrically coupled to the first inverter, the gate terminal of the first N-FET transistor is electrically coupled to an output terminal of a second inverter in the second circuit, the second inverter having an input terminal and the output terminal, the gate terminal of the first P-FET transistor is electrically coupled to the input terminal of the second inverter, the gate terminal of the first P-FET transistor and the input terminal of the second inverter are further electrically coupled to an OR function of the power gate signal and the bypass signal, the source terminal of the second P-FET transistor is electrically coupled to the voltage source, the drain terminal of the second P-FET transistor is electrically coupled to the source of the second N-FET transistor, the drain terminal of the second P-FET transistor and the source of the second N-FET transistor are electrically coupled to a gate terminal of a P-FET transistor of the second circuit, the drain terminal of the second P-FET transistor, the source of the second N-FET transistor, and the gate terminal of the P-FET transistor of the second circuit are further electrically coupled to the output of the first inverter, the gate terminal of the second P-FET transistor is electrically coupled to a complement of the power gate signal, the gate terminal of the second N-FET transistor is electrically coupled to the bypass signal, and the drain terminal of the second N-FET transistor is electrically coupled to electrical ground.

* * * * *